US010806239B2

(12) United States Patent
Hinson

(10) Patent No.: US 10,806,239 B2
(45) **Date of Patent: *Oct. 20, 2020**

(54) RIGID METAL RESERVOIR HYDRATION SYSTEM

(71) Applicant: Matthew Calvin Hinson, Houston, TX (US)

(72) Inventor: Matthew Calvin Hinson, Houston, TX (US)

(73) Assignee: Matthew Calvin Hinson, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/448,349

(22) Filed: Jun. 21, 2019

(65) Prior Publication Data

US 2019/0313777 A1 Oct. 17, 2019

Related U.S. Application Data

(63) Continuation of application No. 15/821,737, filed on Nov. 22, 2017, now Pat. No. 10,390,603.

(51) Int. Cl.

| | |
|---|---|
| ***A45F 3/16*** | (2006.01) |
| ***A45F 3/04*** | (2006.01) |
| ***B65D 47/12*** | (2006.01) |
| ***B65D 43/02*** | (2006.01) |
| ***A45F 3/18*** | (2006.01) |
| ***A45C 7/00*** | (2006.01) |
| ***A45F 5/00*** | (2006.01) |
| ***A45F 5/02*** | (2006.01) |

(52) U.S. Cl.

CPC ..... *A45F 3/16* (2013.01); *A45C 7/0086* (2013.01); *A45F 3/04* (2013.01); *A45F 5/00* (2013.01); *A45F 5/021* (2013.01); *B65D 43/0231* (2013.01); *B65D 47/122* (2013.01); *A45F 3/18* (2013.01); *A45F 2003/166* (2013.01); *B65D 2543/00537* (2013.01); *B67D 2210/00131* (2013.01)

(58) Field of Classification Search

CPC ..... A45F 2003/166; A45F 3/18; B67D 2210/00131

USPC ..... 224/148.2; 222/175; 220/705; 239/33

See application file for complete search history.

(56) References Cited

U.S. PATENT DOCUMENTS

| | | | | |
|---|---|---|---|---|
| 4,140,150 | A * | 2/1979 | Rundell | B60N 3/18 137/340 |
| 6,199,729 | B1 * | 3/2001 | Drzymkowski | A45F 3/20 138/120 |
| 7,073,678 | B1 * | 7/2006 | Dibdin | A47G 19/2272 220/254.1 |
| 7,311,231 | B2 * | 12/2007 | Noell | A45F 3/20 215/388 |
| 7,490,740 | B2 * | 2/2009 | Robins | A45F 3/20 222/175 |
| 7,600,656 | B2 * | 10/2009 | Karl | A45F 3/18 222/175 |

(Continued)

*Primary Examiner* — Justin M Larson

(57) ABSTRACT

Provided is a novel hydration system which incorporates a rigid, low-profile, contoured reservoir made of stainless steel or another suitable non-plastic material that replaces typical plastic water bladders and a flexible metal drinking hose in backpack-mounted hydration systems. The rigid metal reservoir hydration system solves several problems and health concerns associated with plastic hydration systems.

4 Claims, 37 Drawing Sheets

(56) References Cited

U.S. PATENT DOCUMENTS

| | | | | |
|---|---|---|---|---|
| 8,839,996 | B2 * | 9/2014 | Parazynski | A45F 3/16 224/148.2 |
| 9,186,007 | B2 * | 11/2015 | Srivatsan | A47G 21/185 |
| 9,820,557 | B2 * | 11/2017 | Gottlieb | A45F 3/16 |
| 9,924,781 | B2 * | 3/2018 | Kalalau | A45F 3/16 |
| 10,315,816 | B2 * | 6/2019 | Ehyai | B65D 55/165 |
| 10,390,603 | B2 * | 8/2019 | Hinson | A45C 7/0086 |
| 2002/0092858 | A1 * | 7/2002 | Bowman | A45F 3/16 220/709 |
| 2002/0179647 | A1 * | 12/2002 | Hall | A45F 3/20 222/175 |
| 2005/0191355 | A1 * | 9/2005 | Foss | A01N 57/16 424/486 |
| 2005/0258201 | A1 * | 11/2005 | Willows | B65D 25/22 224/148.4 |
| 2006/0071006 | A1 * | 4/2006 | Lojkutz | A45F 3/20 220/705 |
| 2007/0056998 | A1 * | 3/2007 | Olson | A45F 3/20 224/148.2 |
| 2007/0170280 | A1 * | 7/2007 | Ridgeway | B62J 99/00 239/146 |
| 2011/0127349 | A1 * | 6/2011 | Srivatsan | A47G 21/182 239/33 |
| 2013/0186906 | A1 * | 7/2013 | Underhill | A47G 21/185 220/705 |
| 2015/0150394 | A1 * | 6/2015 | Chai | A47G 21/18 220/705 |
| 2016/0175866 | A1 * | 6/2016 | Kalalau | A45F 3/16 222/175 |
| 2017/0231371 | A1 * | 8/2017 | Li | A45F 3/06 62/259.3 |
| 2019/0150597 | A1 * | 5/2019 | Hinson | A45F 5/021 |

* cited by examiner

Step 1

Step 2

Step 3

Step 4

Step 5

Step 6

Step 7

Step 8

Step 9

Step 12A

Step 12B

Step 13

Step 1

Step 2

Step 3

Step 4

Step 5

RIGID METAL RESERVOIR HYDRATION SYSTEM

CROSS-REFERENCE TO RELATED APPLICATIONS

This continuation application claims the benefit of parent U.S. Nonprovisional application Ser. No. 15/821,737, filed Nov. 22, 2017, entitled RIGID METAL RESERVOIR HYDRATION SYSTEM which is incorporated by reference herein in its entirety.

BACKGROUND

Individuals performing outdoor and sporting activities need to hydrate during their activities. Whether hiking, cycling, running, kayaking, fishing, hunting, or any number of other similar activities, it is preferable to hydrate on-the-go, with minimal interruption to the activity. Otherwise, people may not hydrate adequately, as taking frequent breaks to hydrate may not be desirable or even feasible while performing these activities.

In order to maintain proper hydration levels, people may be required to regularly ingest fluids. There have been several portable devices developed to meet this need. A traditional approach involves the storage and dispensing of drinkable liquids in the form of water bottles or canteens, which are most often in the form of a plastic or metal cylindrical container, which can be carried by the user or stored during an activity inside a hip-mounted holster, a bottle cage mounted on a bicycle, or a number of other storage methods. Water bottles require the use of at least one hand, and can interrupt the user while performing a given activity. The constant interruption of activities and/or the need to use one's hand or hands to hydrate with these bottles and canteens is a well-known nuisance, for which outdoors and sports enthusiasts have sought better solutions through the years.

Alternative approaches involves the use of a backpack-mounted fluid dispensing system. Such systems incorporate a flexible, bag-like (e.g. soft-sided) reservoir or bladder which is mounted on a user's back in a backpack and which contains a drinkable liquid. The liquid is dispensed from the reservoir through a flexible tube which is routed to a user's mouth. Typically the liquid may be dispensed at the will of the user by means of the operation of a "bite valve", which the user typically operated by means of a pinching or biting action on the valve. This method of hydration during an activity offers the advantage of hands-free and interruption-free operation which is typically preferable during outdoor and sporting activities.

There are significant benefits to using backpack-mounted hydration systems over water bottles and canteens. According to a scholarly article entitled, "Hydration Packs Modify Professional Skiers Hydration Levels in All Day Skiing: A Randomized Controlled Trial" (STP1525), published by researchers from The University of Canberra and published by the American Society for Testing and Materials, "The effect of a backpack hydration system on hydration levels of professional snowsport employees was explored by an interdisciplinary research team. On two consecutive days, a total of 33 subjects were involved in a study where on one day they would wear a backpack hydration pack, while on the other day they would hydrate as per their normal work practice. When the two days were compared, wearing a hydration pack resulted in significantly higher levels of hydration, 0.4% (95% CI 0.017-0.765, range of −1.40-3.00%) significant at a 0.05 two-tailed level, at the end of the day. It is not clear as to whether this level of hydration change is important in terms of impacting on the skills required for safe snowsports participation. However, if the effects are continuous, any negative hydration change may be associated with some level of performance loss. This research raises important questions related to access to water by all users of snowsport resorts. If hydration levels may be impacted upon by the use of hydration packs, there may be other aspects of the design "equation" that may facilitate optimal hydration levels for snowsport participants."

Another study that demonstrates the clear benefits of back-mounted hydration systems over water bottles and canteens was conducted by researchers of the American College of Sports Medicine, entitled, "The Influence of a Back Mounted Hydration System on Fluid Homeostasis during Hiking" and published in *Medicine & Science in Sports & Exercise*: May 2004—Volume 36—Issue 5—p 5181, concludes, "Subjects maintained hydration status at baseline levels during four hours of hiking when using a back mounted hydration system. Even with sufficient fluid quantities available and ad libitum access, subjects became significantly dehydrated during the water bottle trial. Although subjects started the hike with equal volumes of water, better accessibility led to greater ingestion and enhanced performance during the back mounted hydration system trial."

Existing fluid dispensing systems typically incorporate a collapsible plastic or polymer reservoir which is mounted in a backpack. Water is delivered from the reservoir to a user's mouth via a flexible plastic tube, and a user-actuated valve (typically called a bite valve). Problems with current systems include a plastic taste in the water; health concerns regarding the leaching of chemicals from the plastic reservoirs and other plastic components into the drinking water; difficulty and ineffectiveness with cleaning and drying flexible reservoirs; health concerns regarding mold, mildew, and/or bacteria growth within these flexible reservoirs, often occurring due to ineffective or improper cleaning; the potential for the flexible plastic reservoirs to burst, rip, or tear when a user falls on them or when impact is made with the reservoir during a sporting activity, potentially causing water damage to other items held in a backpack by the user, such as electronics, food, etc.; the dissatisfaction of water becoming warm over the course of an activity in which the hydration system is in use or stored in a hot environment such as an automobile during transport to an activity's location; the condensation formed on the reservoir's surface (also known as "sweating") when cold water and ice are stored in the reservoir on a warm or hot day, causing the user and the contents of the backpack to become wet, potentially causing damage to electronics or food; and the tendency for flexible plastic reservoirs to shape shift within the user's backpack, causing issues with weight load and other objects shifting around within the backpack. As a result many people have resorted to using traditional water bottles made of stainless steel which do not cause some of the above-mentioned concerns. However, as mentioned above, traditional water bottles and canteens are not as convenient and do not offer a hands-free solution. More detailed descriptions of the above-mentioned problems are given in the following paragraphs.

Plastic Taste:

A simple internet key word search (e.g. "plastic taste in hydration pack") will reveal an obvious problem regarding the taste of the water in plastic reservoir hydration systems. A peer-reviewed publication performed by University of Texas researchers entitled "Estrogenic Chemicals Often Leach From BPA-Free Plastic Products That Are Replacements for BPA-Containing Polycarbonate Products" (PubMed PMID: 24886603) demonstrates that all of the common plastics and even the latest Tritan™*plastic* materials used to make plastic hydration reservoirs leach chemicals exhibiting estrogenic activity (EA) into drinking water, which may have endocrine-didrupting health effects. The presence of these types of chemicals is known to present a noticeable distinctive taste referred to by many as a "chemical" or "plastic" taste. A article published by Wilderness & Environmental Medicine, September 2008: Vol. 19, Issue 3, pg(s) 172-180 doi: 10.1580/07-WEME-OR-114.1, entitled, "Effects of an Electrolyte Additive on Hydration and Drinking Behavior During Wildfire Suppression" found in their study that "Oftentimes CamelBak packs incur a "plastic" taste to water."

Furthermore, in a Virginia Tech published thesis for Master of Science in Environmental Engineering by Timothy Heim entitled, "Impact of Polymeric Plumbing Materials on Drinking Water Quality and Aesthetics" (https://theses.lib.vt.edu/theses/available/etd-05062006-111337/unrestricted/MSThesisTimHeim.pdf), shows a direct link between the leaching of plastic chemicals into drinking water and the unpleasant taste many describe as a "plastic taste."

How the Present Invention Improves Upon Current Solutions to Solve this Problem:

The rigid metal reservoir hydration system of the present invention eliminates the taste of any plastic or chemical from the dispensed drinking water. In a controlled study, the rigid metal reservoir hydration system was filled with drinking water alongside as were five of the leading branded hydration systems on the market. Each was filled at the same time with water from the exact same source, and 100 users were asked to sample water from each system. While each hydration system from current leading brands received feedback indicating a plastic taste was present from at least 90 of 100 users, the rigid metal reservoir hydration system did not receive any feedback reporting a plastic taste or any unpleasant taste whatsoever.

Health Concerns Regarding Chemical Leaching:

Another growing and perhaps more serious concern regarding the use of plastic reservoir hydration systems is that of chemicals leaching into the water and the long-term health effects of ingesting these chemicals. Many people who have switched from plastic reservoir hydration systems to stainless steel water bottles have done so not only because of the chemical taste they detected in the water, but also because of the belief that if the taste of chemicals is present in the water, then chemicals must be present in the water. Multiple studies have shown that plastic water reservoirs do release small amounts of chemical compounds into the drinking water which are now known endocrine disruptors, which have some serious potential side effects.

BPA, or bisphenol-A, is a common chemical which was traditional used in plastic water bottles and flexible plastic reservoirs. BPA has been acknowledged as an endocrine disruptor by the US Food and Drug Administration, the World Health Organization and many other researchers for many years. The Endocrine Society said in 2015 that the results of ongoing laboratory research gave grounds for concern about the potential hazards of endocrine-disrupting chemicals—including BPA—in the environment, and that on the basis of the precautionary principle these substances should continue to be assessed and tightly regulated. A 2016 review of the literature said that the potential harms caused by BPA were a topic of scientific debate and that further investigation was a priority because of the association between BPA exposure and adverse human health effects including reproductive and developmental effects and metabolic disease. Many plastic hydration reservoir manufacturers have ceased the use of BPA in their products and now tout the phrase "BPA Free" on most hydration system packaging.

BPS, or bisphenol-S, is now the common replacement additive in most plastic hydration system reservoirs. Unfortunately, new studies have shown that BPS may be as hazardous or even more hazardous than BPA to human health regarding endocrine disruption and other potential side effects. The most notable recent study on BPS with these conclusions was done by University of Texas scientists and is the first to link low concentrations of bisphenol S (BPS)—a bisphenol A (BPA) alternative—to disruption of estrogen, spurring concern that it might harm human health.

Researchers exposed rat cells to levels of BPS that are within the range people are exposed to. And, just like BPA, the compound interfered with how cells respond to natural estrogen, which is vital for reproduction and other functions. Previous studies already have shown BPS mimics estrogen, but the new study advances that by showing it can alter the hormone at low doses people are exposed to. "People automatically think low doses do less than high doses," said Cheryl Watson, a University of Texas biochemistry professor and lead author of the study published in Environmental Health Perspectives. "But both natural hormones and unnatural ones like [BPS] can have effects at surprisingly low doses."

Even newer plastic hydration reservoirs which claim to be free of BPA and BPS still may have chemicals which are known to have negative side effects on humans Phthalates, or phthalate esters, are esters of phthalic acid and are mainly used as plasticizers, which are substances added to plastics to increase their flexibility, transparency, durability, and longevity. One common phthalate found in plastic hydration reservoirs is di(2-ethylhexyl)phthalate or DEHP. DEHP and other phthalates are known as potential causes of endocrine disruption, cancer, and prenatal birth defects.

Some of the latest plastic flexible reservoirs used by the CamelBak™ hydration system brand and some others tout that their reservoirs are free of BPA and BPS, by using a substitute chemical compound called Tritan™, which is claimed to be safe and free of endocrine disruptors. However, a peer reviewed scholarly article published in *Food Chemistry*, Volume 141, Issue 1, 1 Nov. 2013, Pages 373-380, titled "Migration of plasticisers from Tritan™ and polycarbonate bottles and toxicological evaluation", claims, in summary, that Bisphenol A, dimethyl isophthalate, and others compounds were detected Tritan™, which in higher concentrations had estrogenic (endocrine disruption) effects.

Some have argued that Tritan™ has a wide range of adverse effects such as severe dizziness, drowsiness, excitability, headaches, anxiety, vomiting, nervousness, sleep disorders, urinary dysfunction, heart palpitations, hallucinations, seizures, tremors, an macular disorders.

How the Present Invention Improves Upon Current Solutions to Solve this Problem:

The rigid metal reservoir hydration system of the present invention eliminates the use of plastic polymeric compounds and plasticizers which may exhibit estrogenic activity (EA) leaching into the system's drinking water. When tested in identical conditions to and compared with the leading plastic reservoir for back-mounted hydration systems, which is made of Tritan™ polymer, as well as other leading brands' plastic reservoirs, the rigid metal reservoir hydration system of the present invention leached zero plasticizers or polymeric compounds into the drinking water held within. Compounds identified in Tritan™ were 2-phenoxyethanol (2-PE), 4-nonylphenol (4-NP), bisphenol A (BPA), benzylbuthyl phthalate (BBP) and dimethyl isophthalate (DMIP) at levels from 0.027±0.002 to 0.961±0.092 μg/kg, although in the 3rd migration period, BBP and DMIP were the only compounds detected well below the specific migration limit. On the other hand, BPA was the only compound detected in polycarbonate (PC) polymers at a mean concentration of 0.748 μg/kg. In vitro bioassays for (anti)estrogenic, (anti) androgenic as well as retinoic acid- and vitamin D-like activity were negative for Tritan™ and PC migrates. BPA and DMIP were estrogenic in high concentrations. Exposure of the estrogen-sensitive molluskan sentinel Potamopyrgus antipodarum confirmed the estrogenic activity of BPA in vivo at 30 μg/L.

Cleaning is a Pain:

Although improvements have been made to flexible plastic reservoir hydration systems, the reservoirs of these systems are often expensive and difficult to clean due to their construction. Flexible or "soft-sided" reservoirs (e.g. bladders, bags, etc.) are typically constructed from two sheets of high grade plastic which are bonded or welded together along their edges to create a bag with water-tight seams. Components are then attached to these reservoirs or bags for filling and dispensing fluids, such as an input port with a large threaded neck and cap to fill the bag which ice, water, or other liquids, and an output spout with a bonded or welded drinking tube. These reservoirs or bags usually have many internal corners, crevices, and seams which are difficult to clean with conventional methods. For example, these collapsible bags typically include small voids or traps which are difficult to clean and often require accessories for facilitating proper cleaning (e.g. a hanging rack, special brushes, etc.) to permit cleaning fluid access and/or air circulation. In many cases, the difficulties associated with cleaning collapsible plastic reservoirs tend to outweigh the usefulness of the hydration bag as a desirable system for providing hydration to a user.

How the Present Invention Improves Upon Current Solutions to Solve this Problem:

The rigid metal reservoir hydration system of the present invention reduces the amount of cleaning required. On average, testing showed that the number of times required to clean a plastic reservoir in order to properly maintain it, including required drying time to avoid mold and mildew growth, was once per one use. The rigid metal reservoir hydration system, because of the materials used in the system, does not promote mold or mildew growth or accumulation, allowing the recommended number of cleanings to be reduced to once per ten uses while still maintaining a sanitary hydration system.

Health Concerns Regarding Bacteria, Mold, and/or Mildew:

It is common knowledge in the healthcare and medical community that mold and mildew are known to cause respiratory problems, common allergic reaction symptoms, nervous-system disorders and depression. Bacteria, which can accumulate in crevices within plastic reservoirs when not properly cleaned and dried, can also cause health issues for users.

How the Present Invention Improves Upon Current Solutions to Solve this Problem:

The rigid metal reservoir hydration system of the present invention provides a mold and mildew resistant solution. In a controlled study, three of the leading plastic hydration systems and the rigid metal reservoir hydration system of the present invention were filled with water and subsequently drained through the drinking tubes to mimic normal use. No effort was made to dry or clean the reservoirs or drinking tubes, and the lids were left closed. Hydration systems were placed in the back of an SUV and left there undisturbed for three weeks. The hydrations systems were then all opened and inspected for mold and mildew. All three of the plastic hydration systems had significant amounts of mold and mildew inside their reservoirs and drinking tubes, while the rigid metal reservoir hydration system of the present invention had zero mold and mildew inside.

Potential for the Flexible Plastic Reservoirs to Burst, Rip, or Tear:

Off-road cyclists, runners, hikers, and other users of hydration systems may sometimes fall back on their hydration packs causing plastic reservoirs to burst, which can damage or ruin other contents carried within the backpack such as electronics or clothing which needs to remain dry to maintain thermal qualities in cold environments. Sharp edged or pointed objects within the backpack may also puncture plastic hydration reservoirs, causing the same damage described above to other contents in the backpack. In addition to contents becoming wet from the bursting or puncture of plastic hydration reservoirs, the user may become wet, potentially causing discomfort, inconvenience, or worse in particularly cold environments.

How the Present Invention Improves Upon Current Solutions to Solve this Problem:

The rigid metal reservoir hydration system of the present invention provides a more puncture-resistant solution than current plastic reservoir hydration systems. To demonstrate how the present invention improves upon the current plastic hydration systems against puncture from sharp objects which may be stored inside hiking packs, an open folding camping knife was dropped, from a height of two feet above the rigid metal reservoir of the present invention, filled with water, so that the point of the knife blade landed on the reservoir. After over 100 drops, the metal reservoir was never punctured. When performing this test on three of the leading plastic reservoirs, a puncture occurred an average of 90 times for each 100 drops.

Furthermore, the present invention design also provides a burst resistance solution from falls onto the reservoir during activity. In a controlled test, three of the leading plastic reservoir hydration systems and the rigid metal reservoir hydration system of the present invention were filled with water and mounted inside identical backpacks which were each strapped to a 170-lb. dummy, which was dropped from four feet to a hard, rocky surface, oriented so that the backpack was sandwiched between the dummy and the ground in order to simulate a cyclist falling back onto his hydration pack. Out of 100 drops, the plastic hydration systems averaged 45 bursts. The rigid metal reservoir hydration system experienced zero bursts or leaks.

Warm Water:

Most users of hydration systems tend to prefer cool or cold water over substantially warm water during strenuous outdoor or sporting activities. Typical plastic hydration reservoirs do not have insulating qualities. Therefore, when hydration packs are stored in vehicles during a drive to a recreational destination or while the hydration pack is worn outside in warm or hot weather, the water or other liquid inside becomes warm, which may also contribute to accelerated plastic chemical leaching concerns as mentioned above.

How the Present Invention Improves Upon Current Solutions to Solve this Problem:

The rigid metal reservoir hydration system of the present invention provides significant improvements in thermal insulative quality to keep water and other drinks cold. A controlled test was conducted in which three of the leading plastic reservoir hydration systems and the rigid metal reservoir hydration system were filled with iced water, the temperature of which was 32 degrees Fahrenheit, and timed for how long it took for the water in each reservoir to reach room temperature, which was 73 degrees Fahrenheit. To ensure quality control, the same amount of water, by volume, and the same amount of ice, by weight, were added to each reservoir. The time it took the best performing plastic reservoir hydration system's water to reach room temperature was two hours and thirty-seven minutes. The time it took the rigid metal reservoir hydration system of the present invention's water to reach room temperature was 47 hours and fifteen minutes.

Condensation or "Sweating":

To address the potential for warm water during an outdoor or sporting activity, some users have added copious amounts of ice to the water inside the plastic reservoirs, which tends to keep water cooler longer, however, when iced water is stored within a plastic reservoir, the reservoir tends to "sweat" in such a manner that moisture condenses on the outer surface of the reservoir, getting other contents of the user's backpack and/or the user wet, which can damage electronics and cause other problems related to wet gear as described above.

How the Present Invention Improves Upon Current Solutions to Solve this Problem:

The rigid metal reservoir hydration system of the present invention eliminates condensate sweating. In a controlled test, three of the leading plastic reservoir hydration systems and the rigid metal reservoir hydration system were filled with iced water, the temperature of which was 32 degrees Fahrenheit. The reservoirs were then placed outside where the ambient temperature was 87 degrees Fahrenheit. The best performing plastic hydration system generated eight fluid ounces of water condensate on its outer surface. The rigid metal reservoir hydration system generated zero condensation on its outer surface.

Shifting Weight and Volume:

Collapsible plastic reservoirs typically take a somewhat cylindrical form or conform to the shape of the container or pack when filled with a liquid. As the liquid is emptied from the reservoir, the reservoir tends to shift or deform, resulting in shifting of the weight on the user and/or distorting the shape of the pack and/or items shifting around inside the pack due to volumetric displacement of the flexible plastic reservoirs. The collapsible plastic reservoirs also tend to be cumbersome to fill with a fluid due to their lack of rigidity. In some cases, a user may freeze the filled reservoir to form a "cold pack" or the like, and the reservoir may take any of a variety of undesirable shapes when frozen, depending on the configuration of the reservoir during the freezing process.

How the Present Invention Improves Upon Current Solutions to Solve this Problem:

The rigid metal reservoir hydration system of the present invention provides an improvement in volumetric stability over the leading plastic reservoir hydration systems. In a controlled test, three of the leading plastic reservoir hydration systems and the rigid metal reservoir hydration system were filled with water to capacity and were secured to the bottom of a vessel filled with water with measuring lines to indicate volume. Each of the hydration systems were drained through their drinking tubes, until empty, and the water in the vessel was measured for displacement compared with its starting measurement. While all of the plastic hydration reservoirs shifted form by a displacement of 3,000 cubic centimeters, the rigid metal reservoir hydration system experienced zero volumetric displacement.

As such, it is clear that neither water bottles nor currently available backpack-mounted hydration systems with collapsible plastic bladders are ideal.

The present invention's contoured and low-profile shape made possible through new and novel metal forming, assembly, and production processes; check-valve; inlet and outlet; and structural features are novel aspects that make a metal reservoir hydration system viable and highly desirable, particularly given the rising concerns with possible side effects of plastic water containers as well as the typical pain points experienced with the use of plastic reservoirs. As described above, the present invention eliminates the taste of any plastic or chemical from the dispensed drinking water, eliminates the use of plastic polymeric compounds and plasticizers which may exhibit estrogenic activity (EA) leaching into the system's drinking water, reduces the amount of cleaning required, provides a mold and mildew resistant solution, provides a more puncture-resistant solution, provides significant improvements in thermal insulative quality to keep water and other drinks cold, eliminates condensate sweating, and provides an improvement in volumetric stability.

Furthermore, although the present invention may utilize a typical plastic drinking tube, the present invention may also utilize a flexible metal tubing, such as flexible copper tubing or similar metal tubing for use in the drinking tube assembly, which would further limit the water's exposure to plastic for reasons detailed above.

The present invention also differs from traditional backpack-mounted hydrations systems in that while current collapsible plastic reservoirs are mounted inside a compartment within a backpack and largely unseen, the rigid metal reservoir of the present invention presents an embodiment which may itself serve as the structural element of the back-mounted hydration system, with minimal textile elements around it, offering an exposed metal aesthetic or style element to complement its utility. Furthermore, metal elements may be added to or molded into the shape of the metal reservoir including but not limited to rings, mounts, handles, pockets, bungee cord, paracord, etc. to which users may mount, hang, or stow items during outdoor activities.

BRIEF SUMMARY OF THE INVENTION

The present disclosure provides for a novel hydration system which incorporates a rigid, low-profile, contoured reservoir made of stainless steel or another suitable non-plastic material that replaces typical plastic water bladders and a flexible metal drinking hose in backpack-mounted hydration systems. The rigid metal reservoir hydration system solves several problems and health concerns associated with plastic hydration systems.

DETAILED DESCRIPTION

Figure 1:
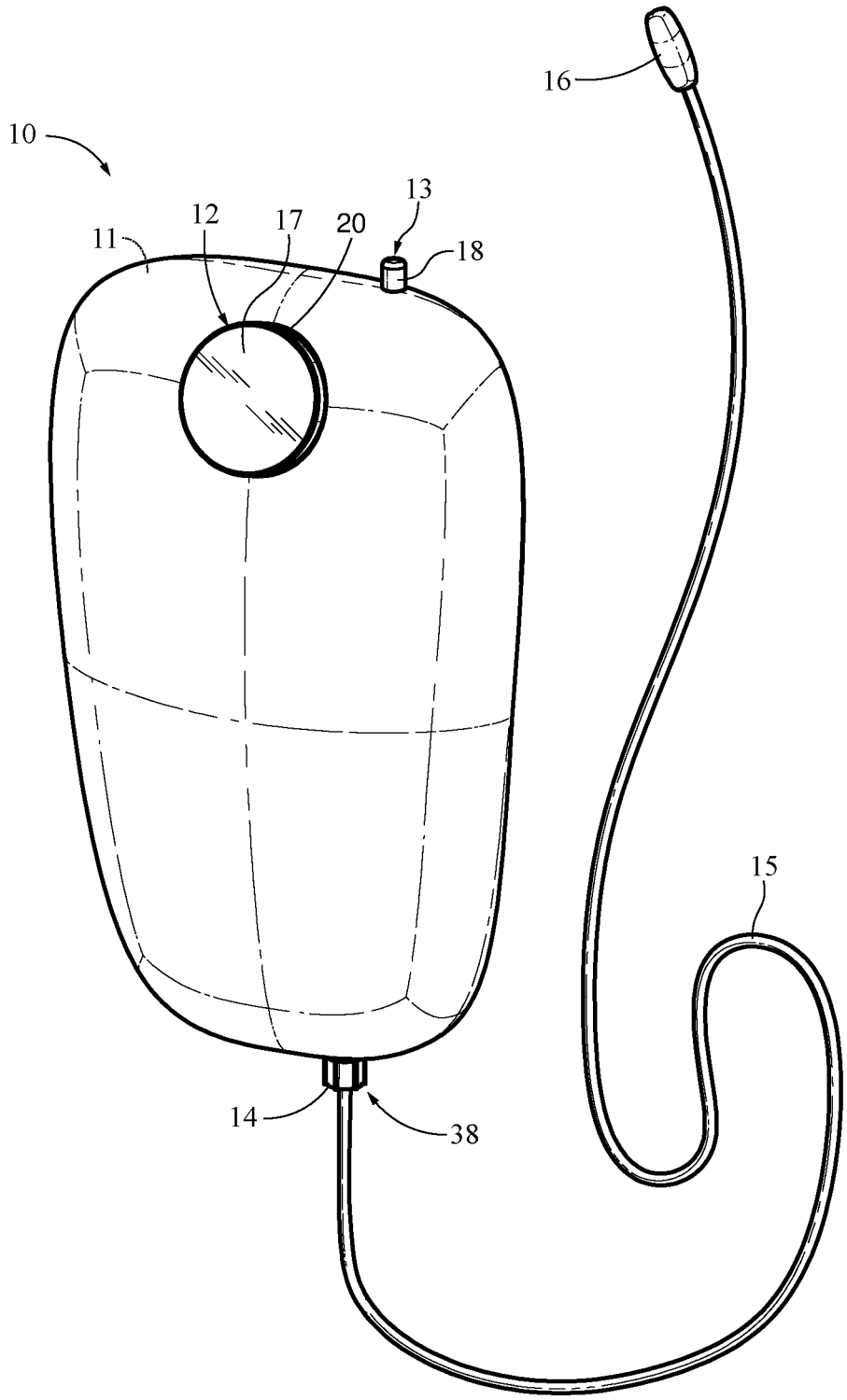
FIG. 1 illustrates an orthogonal view from the front of one embodiment of a hydration system.
Figure 2:
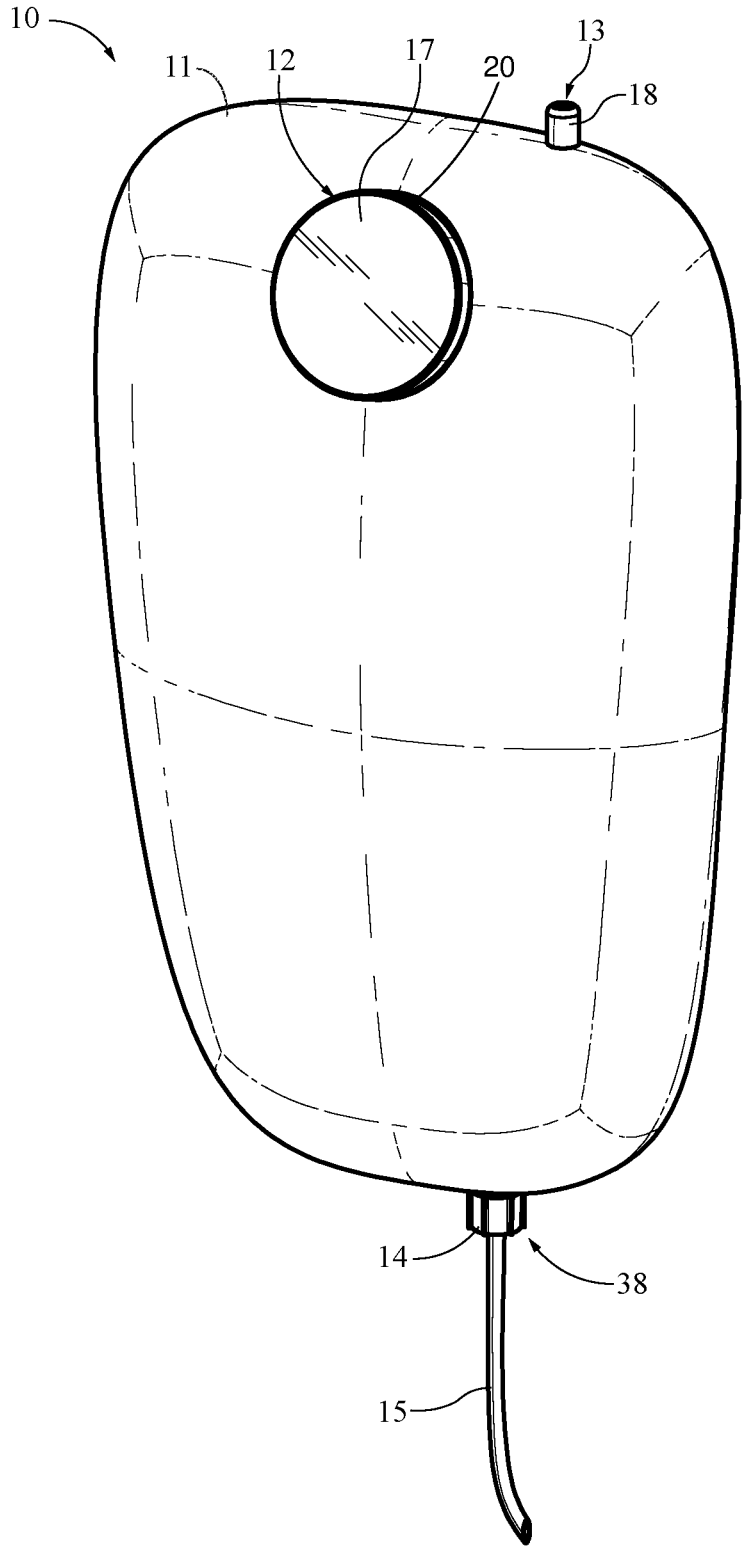
FIG. 2 illustrates closer view from the front of one embodiment the hydration system of FIG. 1.

Referring now to the drawings, wherein like reference numbers are used herein to designate like elements throughout, the various views and embodiments of a rigid metal reservoir hydration system are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring to FIGS. 1-11, several views of one embodiment of a rigid metal reservoir hydration system 10 are illustrated which provides a solution to the problems associated with plastic bladder hydration systems. In the present example, the system 10 includes a water reservoir 11, to which is affixed an Inlet 12, a check valve assembly 13, an outlet 38, a drinking tube 15, and a bite valve 16. The water reservoir 11 may be constructed of stainless steel or any other metal suitable for the safe storage of water or other drinkable liquids. Other suitable materials may include but are not limited to aluminum, titanium, various metal alloys, etc.

The water reservoir 11 may be contoured in such a manner as to conform to the shape and curvature of a user's back for increased comfort and in such a manner as to easily fit in a hydration bladder compartment in a typical backpack or in a backpack designed primarily for use with a hydration system.

The drinking tube 15 may be constructed with a flexible plastic material, which is common among currently available hydration systems, or it may be constructed of flexible copper tubing, which provides a novel means of supplying water or other liquids to the user without the use of plastic, which may be of concern to many users for aforementioned reasons. Furthermore, the copper tubing may be surrounded by a sheath comprised of carbon fiber or another suitable composite material that will allow the copper tubing to bend, but will restrict the bending radius enough so that the copper tubing will not become creased or crimped. The sheathing may be fitted tightly over the copper tubing, but not glued or permanently attached to the outer wall of the tubing, or it may be glued, epoxied, or otherwise permanently affixed to the outer wall of the tubing.

Figure 4:
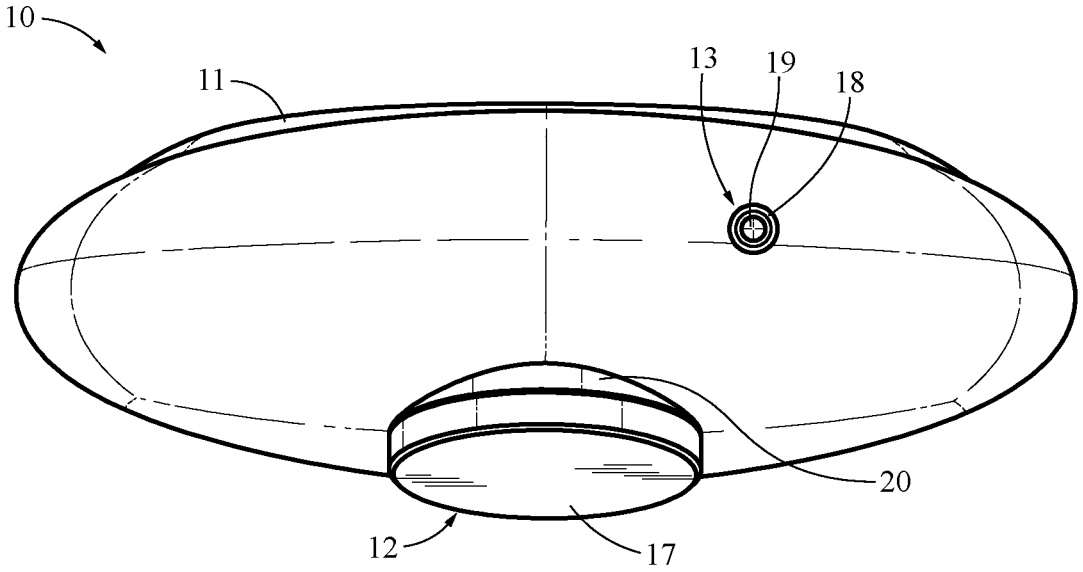
FIG. 4 illustrates a top view of one embodiment the hydration system of FIG. 1.
Figure 5:
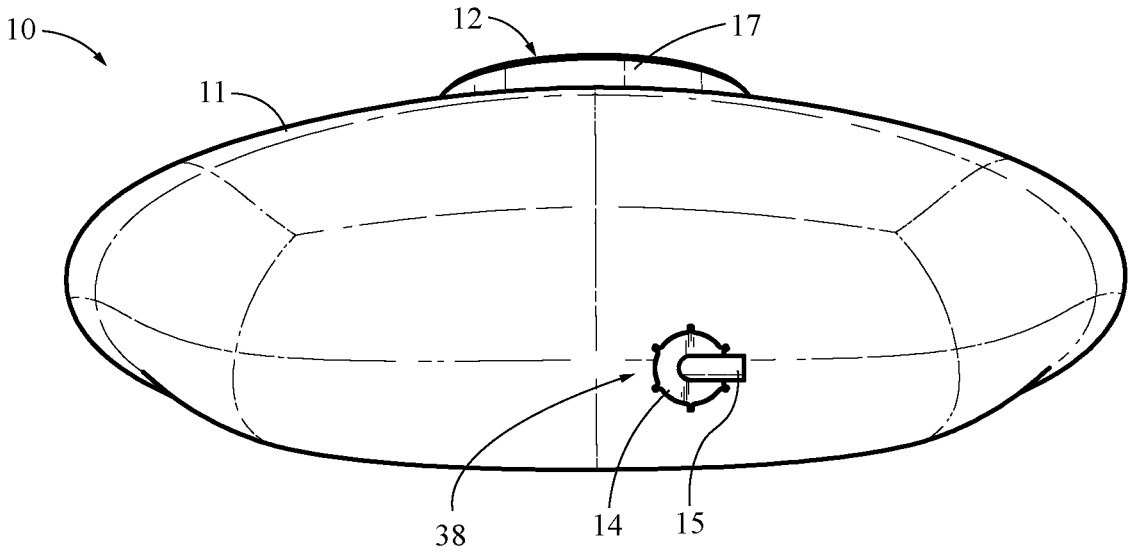
FIG. 5 illustrates a bottom view of one embodiment the hydration system of FIG. 1.
Figure 6:
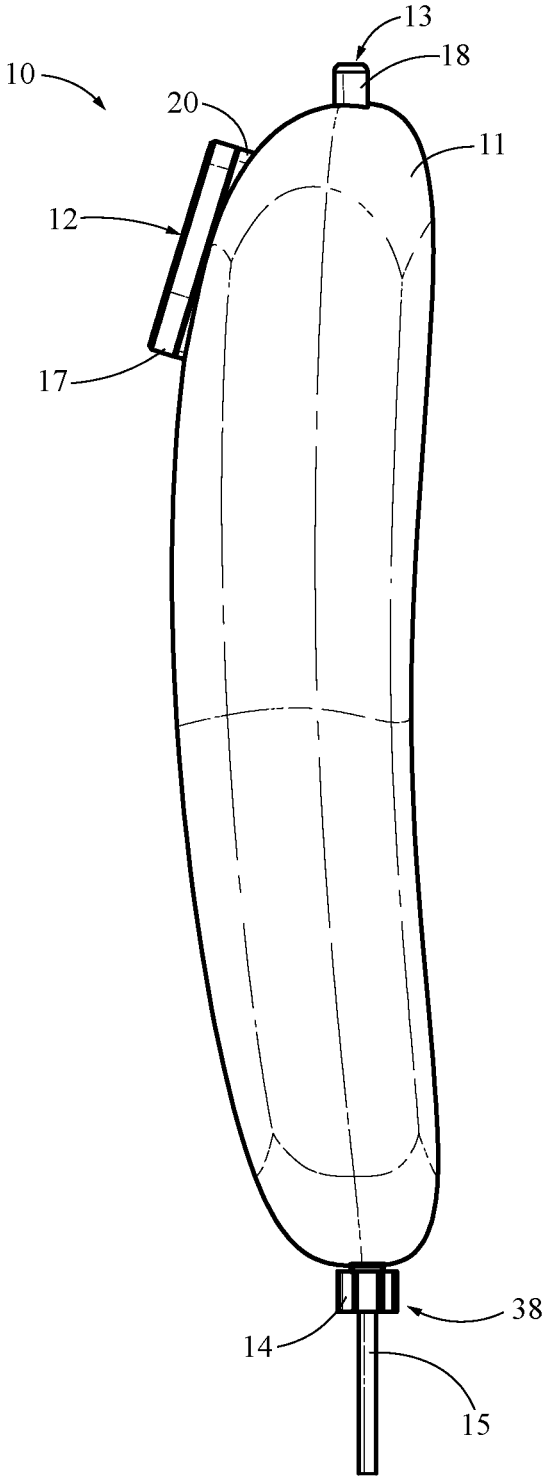
FIG. 6 illustrates a side view of one embodiment the hydration system of FIG. 1.

In this particular embodiment, the Inlet 12 comprises a lid 17 and a lid receiver 20, which is affixed to the reservoir 11, as shown in FIG. 4. The lid 17 and the lid receiver 20 are threaded so that the lid 17 may be tightly secured to the lid receiver 20 by rotating the lid 17 clockwise about the lid axis 35, shown in FIG. 9. Likewise, the lid 17 may be removed from the lid receiver 20 by rotating the lid 17 counterclockwise about the lid axis 35. The lid 17 may be removed temporarily to allow the user of the system 10 to fill the reservoir 11 with water or another drinkable liquid. It is understood that in other embodiments of the system 10 the means and methods of closing or securing a lid 17 to a lid receiver 20 may vary and may take the form of various thread counts sizes and orientations. Other forms of securing a lid 17 to a lid receiver 20 could include a snap-on, press fit, half-twist, click-on, or other type of method to achieve a substantially water-tight seal. The Inlet 12 is set at an angle to the vertical plane of the reservoir 11 such that its location provides ease of use for refilling the reservoir 11 with water or other drinkable liquids.

In this particular embodiment, the outlet 38 comprises the bottom spout tube 21, the bottom spout gasket 22, and the screw cap 14. A hole on the bottom side of the reservoir 11 receives the bottom spout tube 21, which is affixed to the reservoir 11. The bottom spout tube 21 and the screw cap 14 are both threaded in such a manner that the screw cap 14 may be attached to the bottom spout tube 21 by rotating the screw cap clockwise about the bottom spout axis 36, shown in FIG. 9. The outlet 38 connects and secures a drinking tube 15 to the reservoir 11. The drinking tube 15 is routed through a hole in the screw cap 14, centered about the bottom spout axis 36. The drinking tube is affixed to the bottom spout gasket 22, which is compressed between the screw cap 14 and the bottom spout tube 21 to form a water-tight seal. The drinking tube 15 is made of a flexible plastic material, allowing it to easily be routed to a user's mouth. It is understood that the drinking tube 15 may be made of various other materials which may be flexible and appropriate for contact with drinkable liquids.

In this particular embodiment, a bite valve 16 is affixed to one end of the drinking tube 15. The bite valve 16 allows a user to control the flow of water through the hydration system 10.

In this particular embodiment, a hole at the top of the reservoir 11 receives the check valve assembly 13, which comprises the upper check valve body 18, the lower check valve body 23, the check valve spring 24, and the check valve ball 19.

Figure 3:
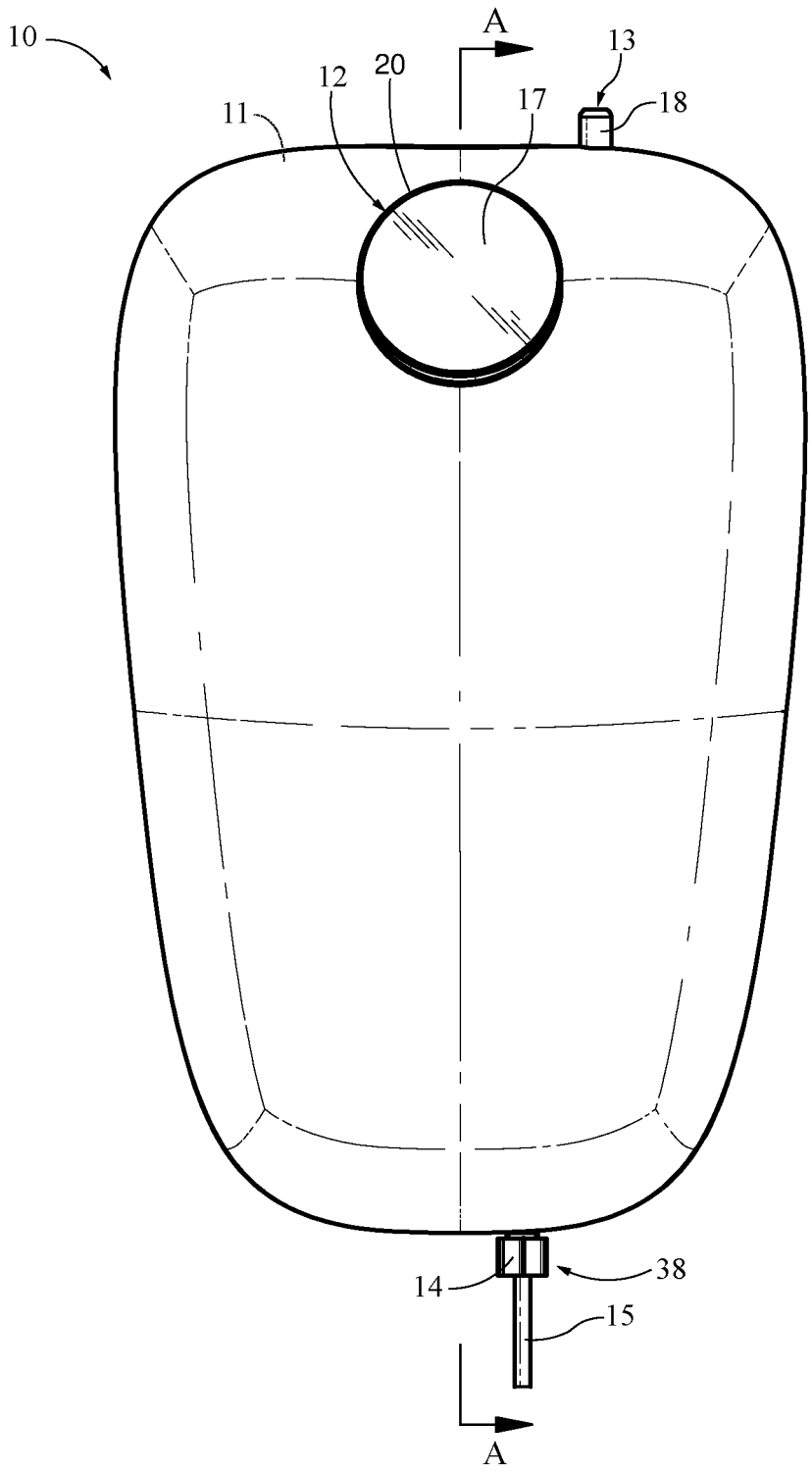
FIG. 3 illustrates a front view of one embodiment the hydration system of FIG. 1.
Figure 7:
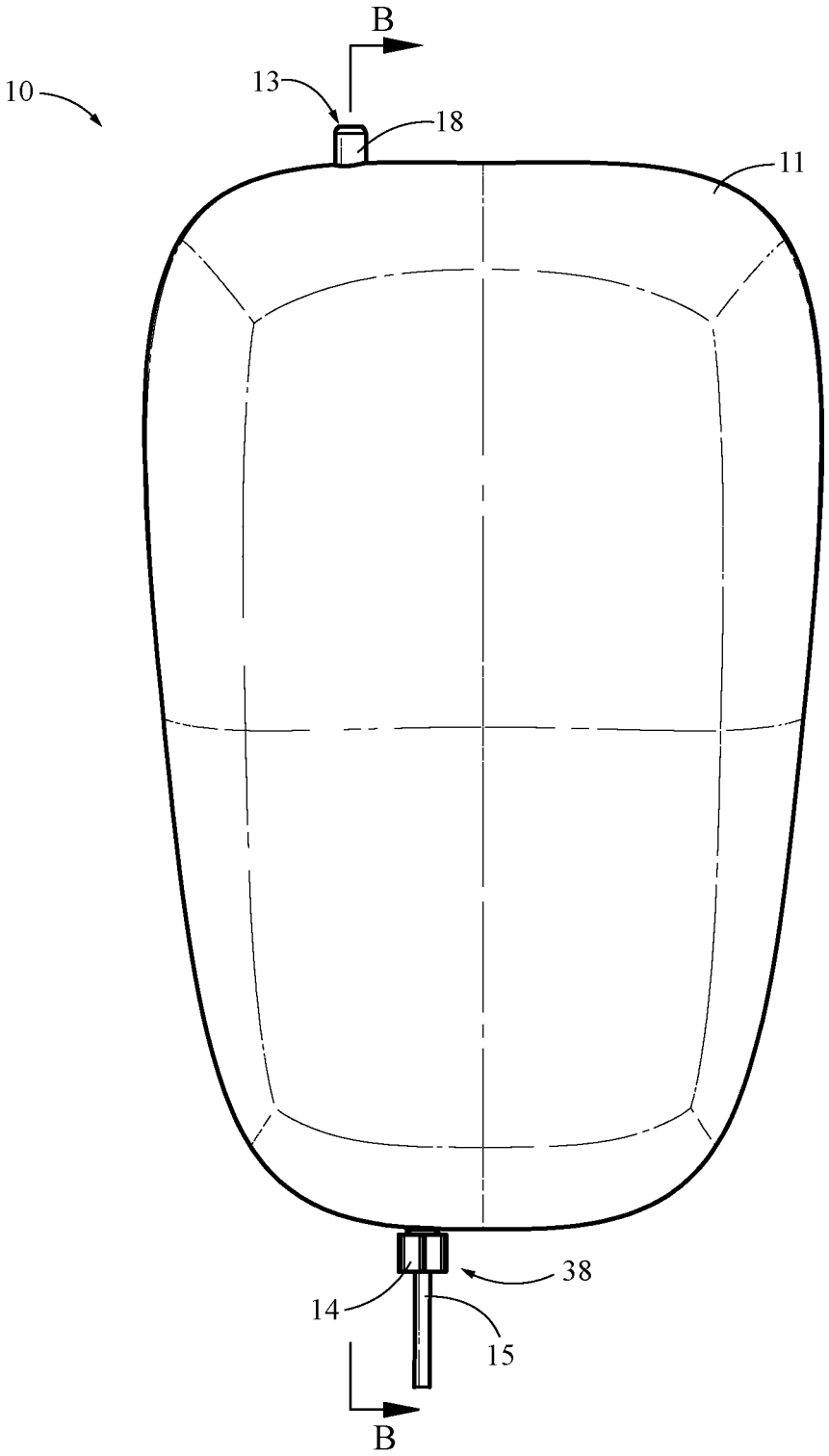
FIG. 7 illustrates a rear view of one embodiment the hydration system of FIG. 1.
Figure 8:
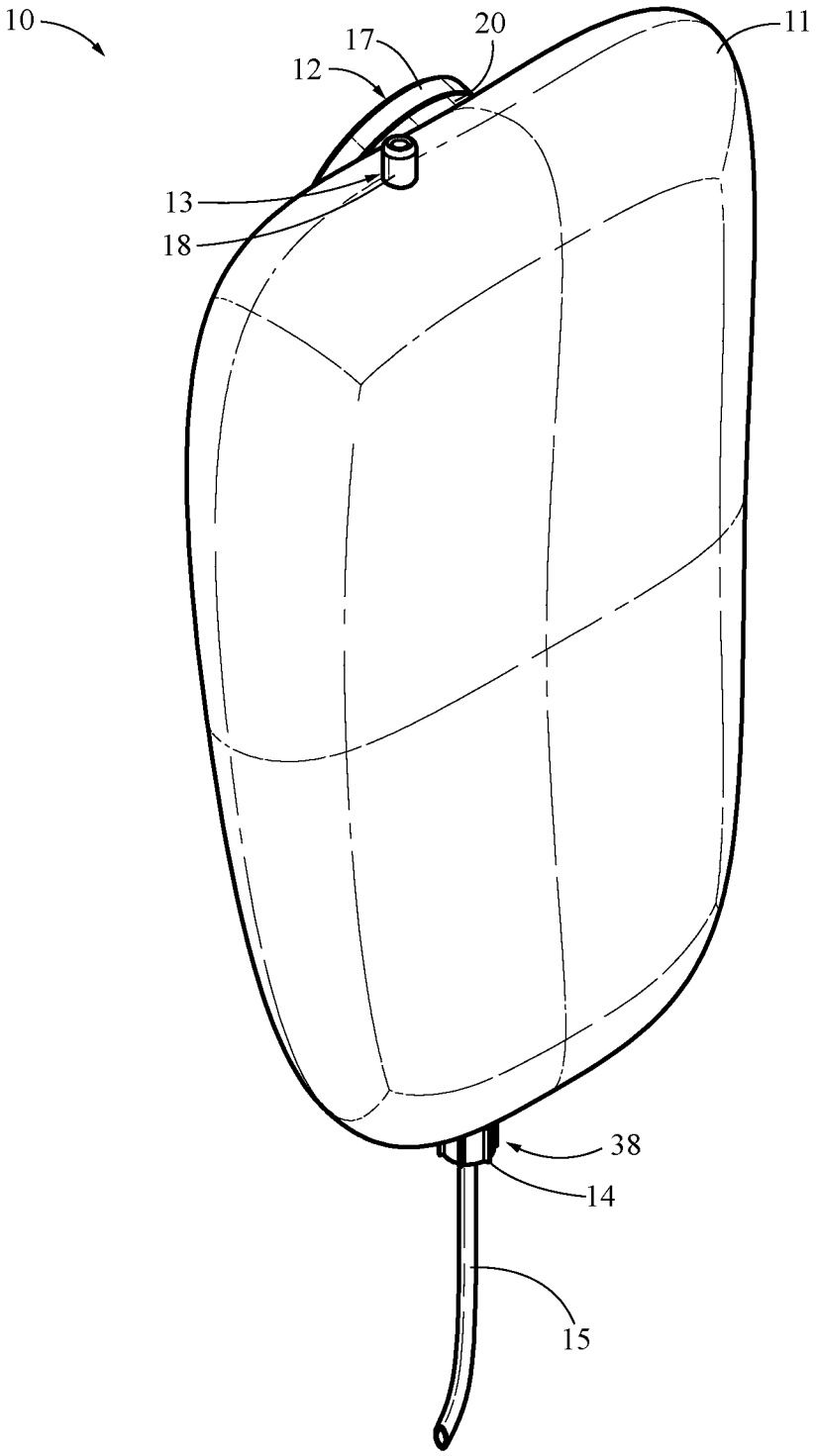
FIG. 8 illustrates an orthogonal view from the rear of one embodiment the hydration system of FIG. 1.
Figure 9:
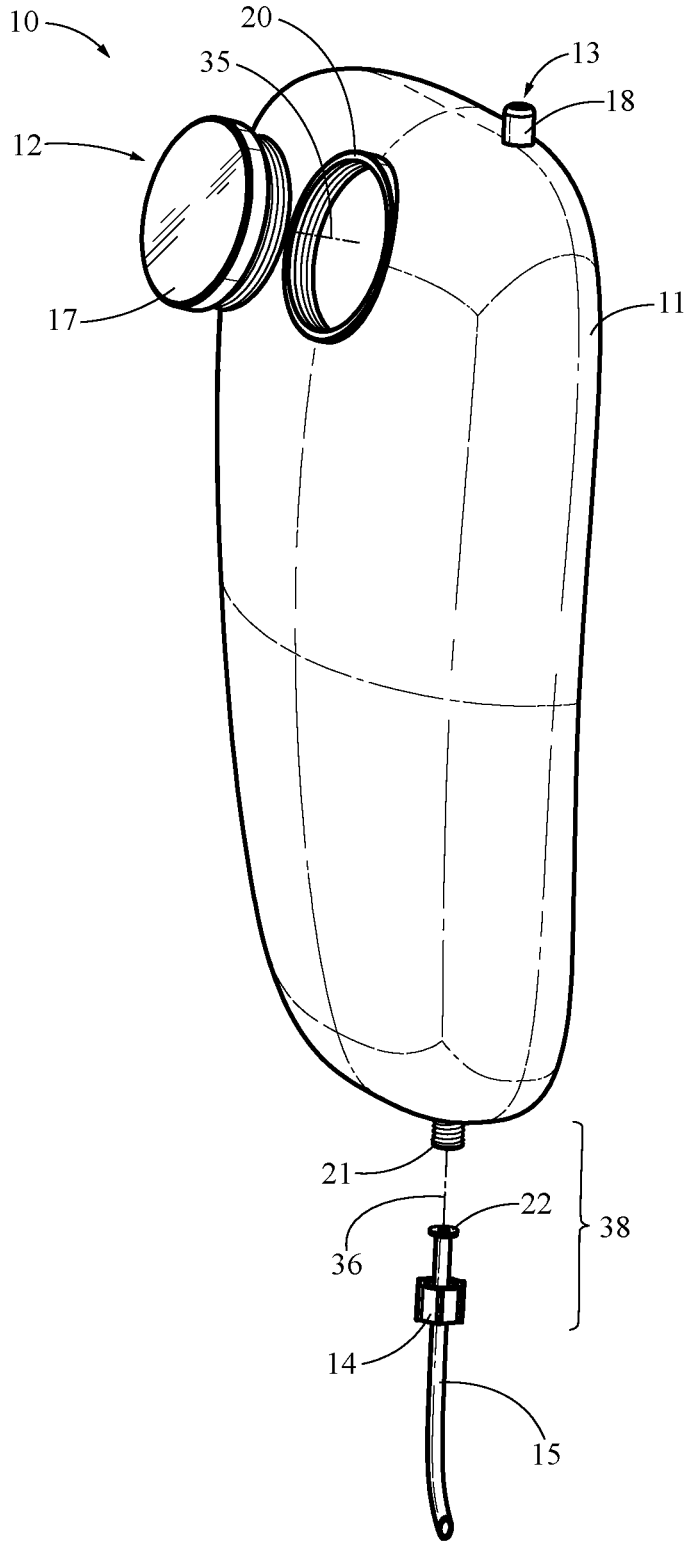
FIG. 9 illustrates a partially exploded view of one embodiment the hydration system of FIG. 1.
Figure 10:
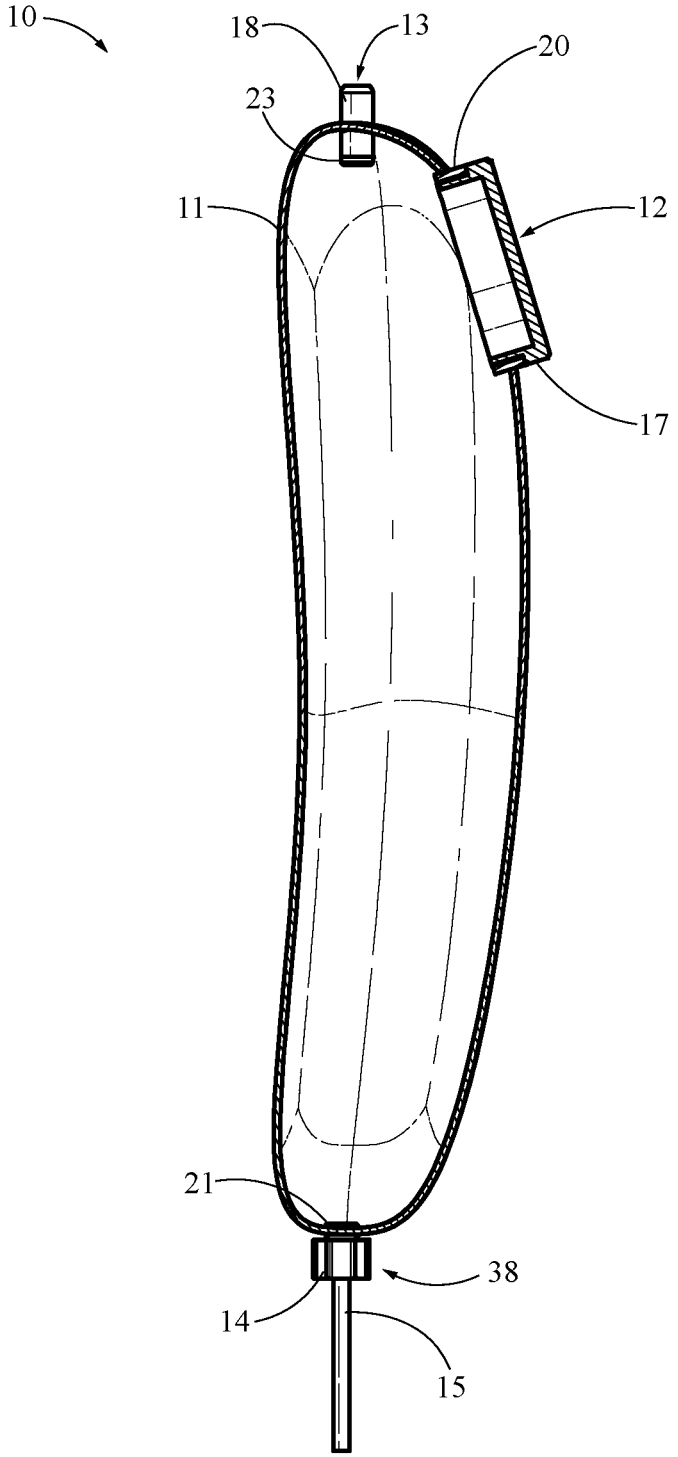
FIG. 10 illustrates a cutaway side view of one embodiment the hydration system of FIG. 3 taken along lines A-A.
Figure 11:
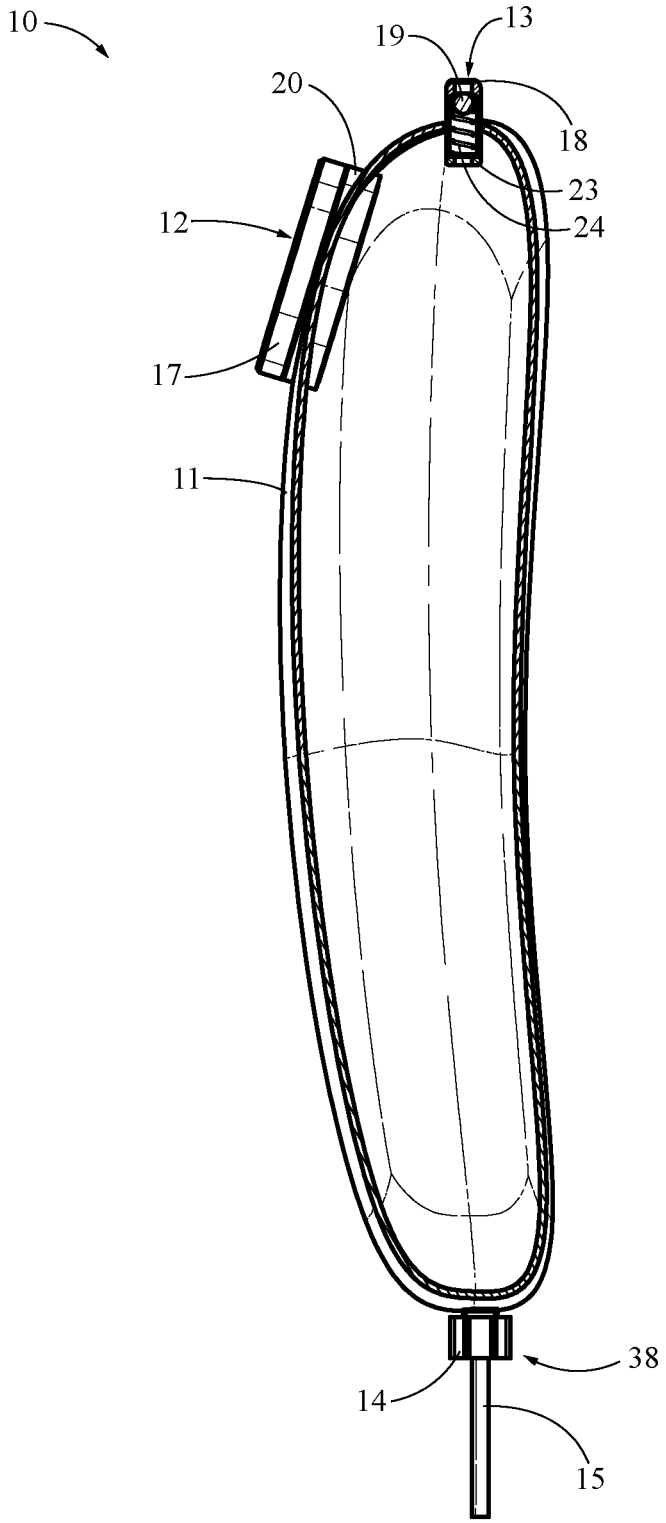
FIG. 11 illustrates a cutaway side view of one embodiment the hydration system of FIG. 7 taken along lines B-B.
Figure 12:
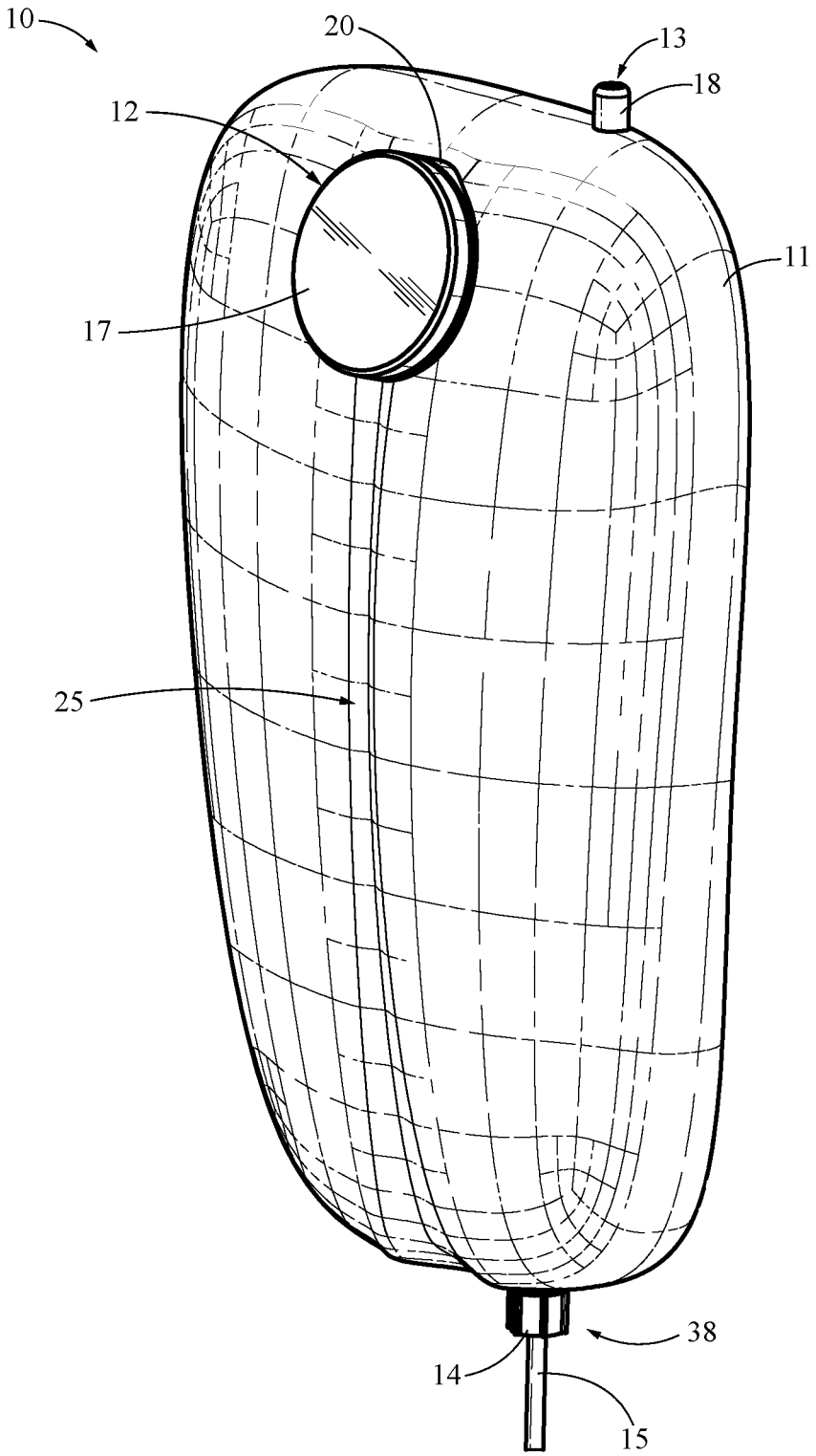
FIG. 12 illustrates an orthogonal view from the front of one embodiment of a hydration system.
Figure 13:
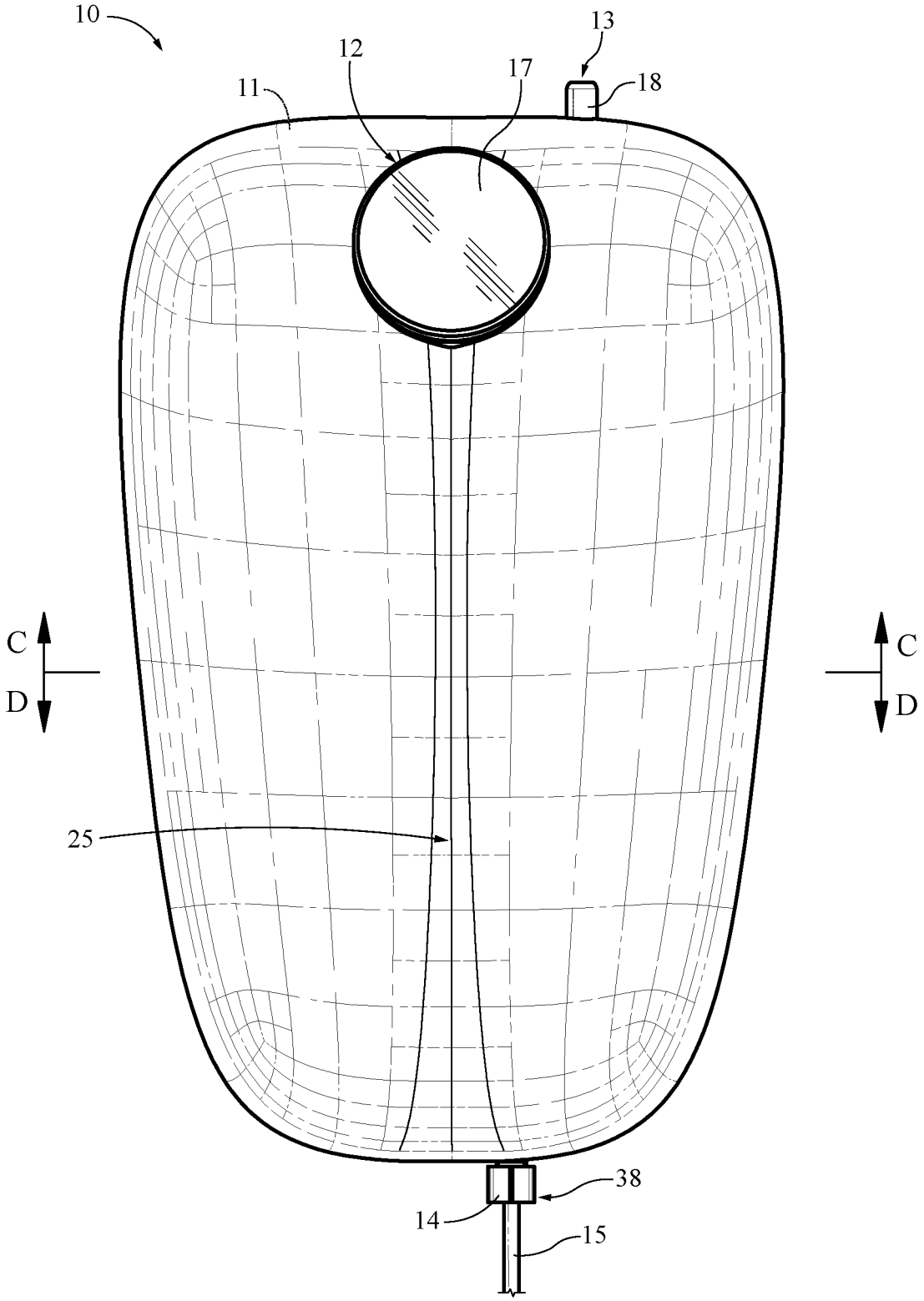
FIG. 13 illustrates a front view of one embodiment the hydration system of FIG. 12.
Figure 14:
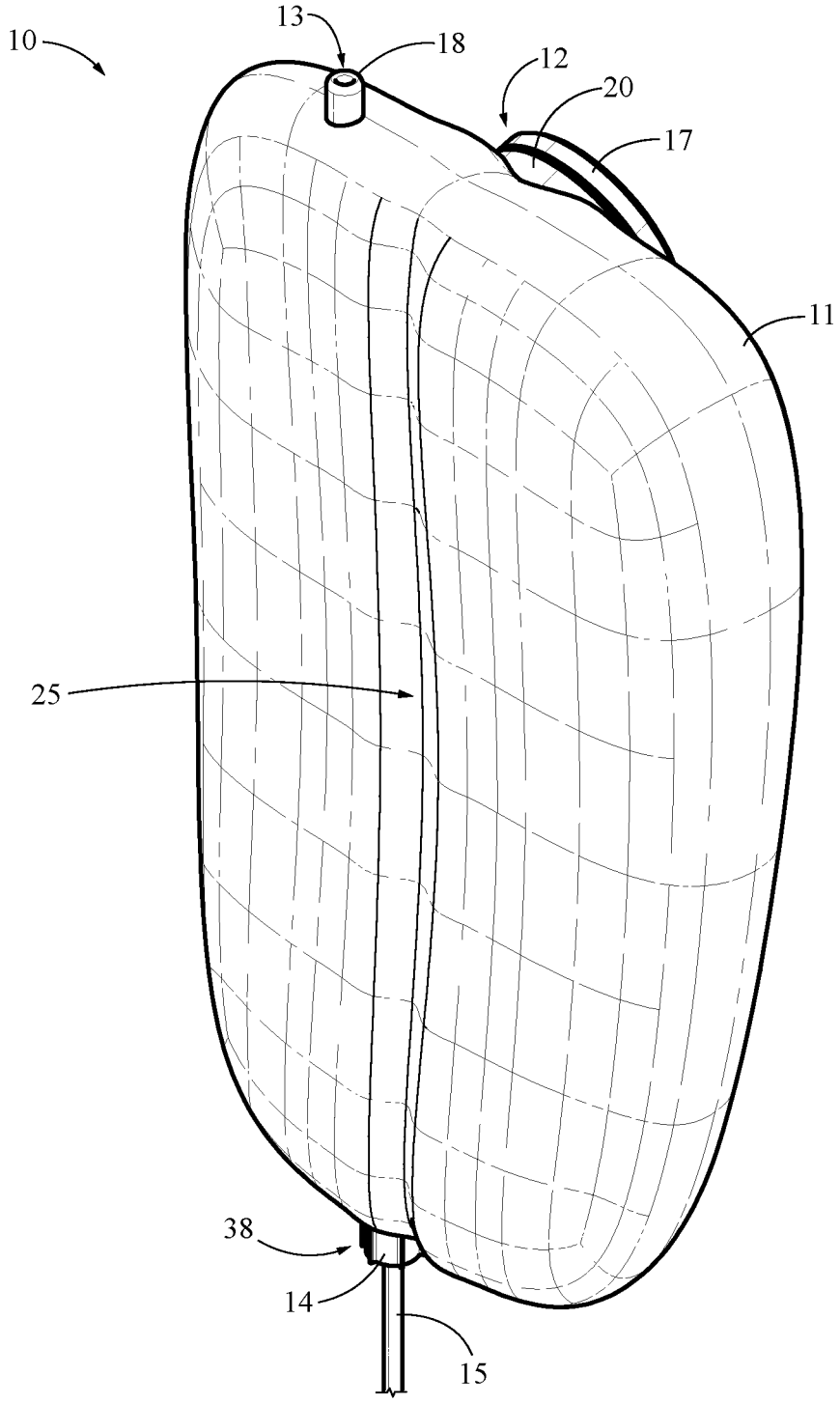
FIG. 14 illustrates an orthogonal view from the rear of one embodiment the hydration system of FIG. 12.
Figure 15:
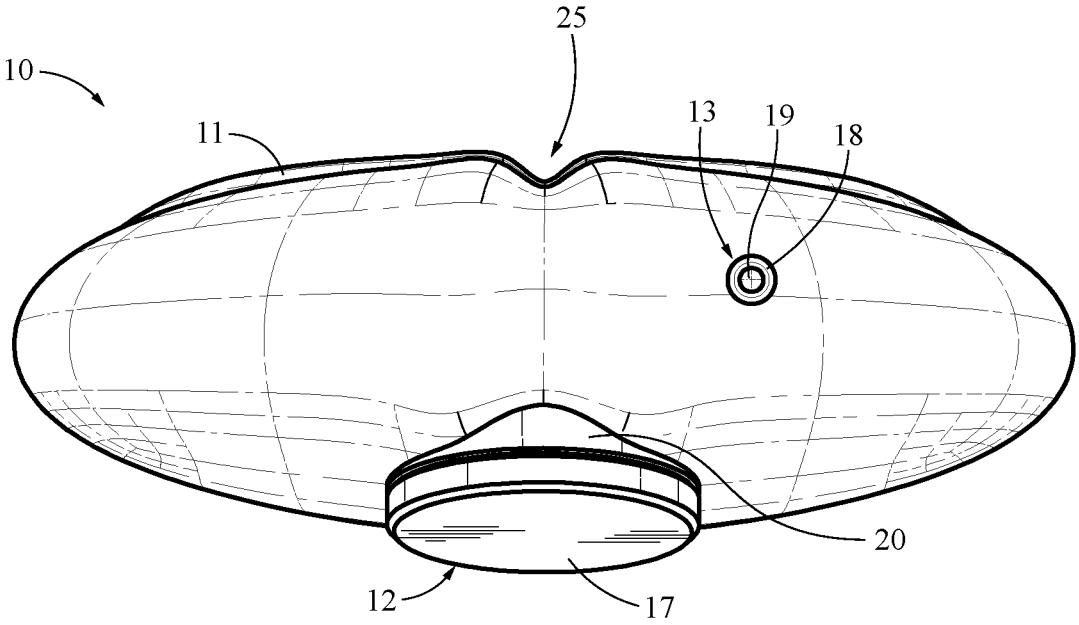
FIG. 15 illustrates a top view of one embodiment the hydration system of FIG. 12.
Figure 16:
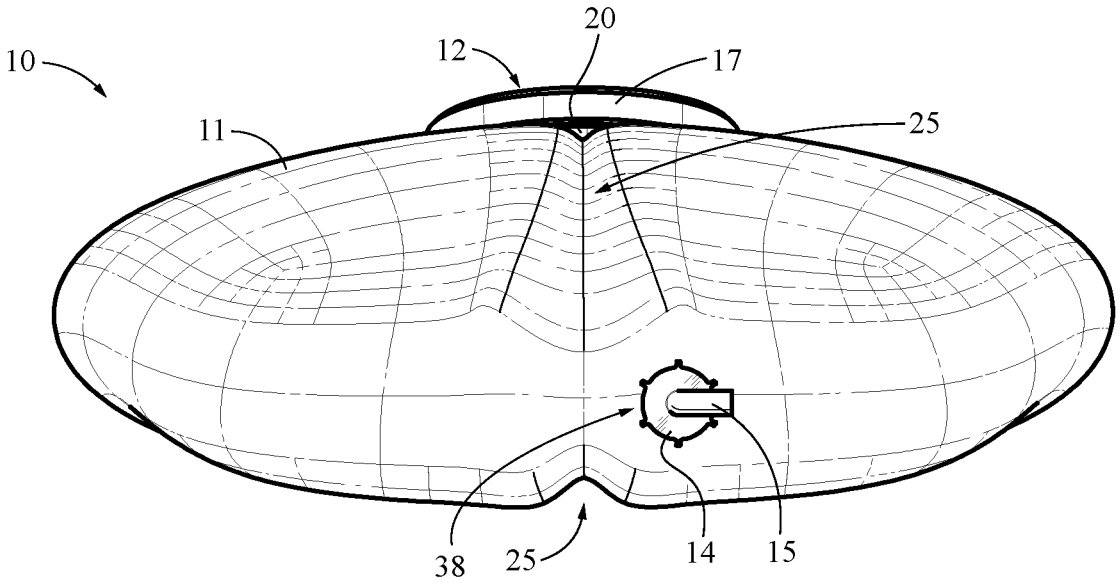
FIG. 16 illustrates a bottom view of one embodiment the hydration system of FIG. 12.
Figure 17:
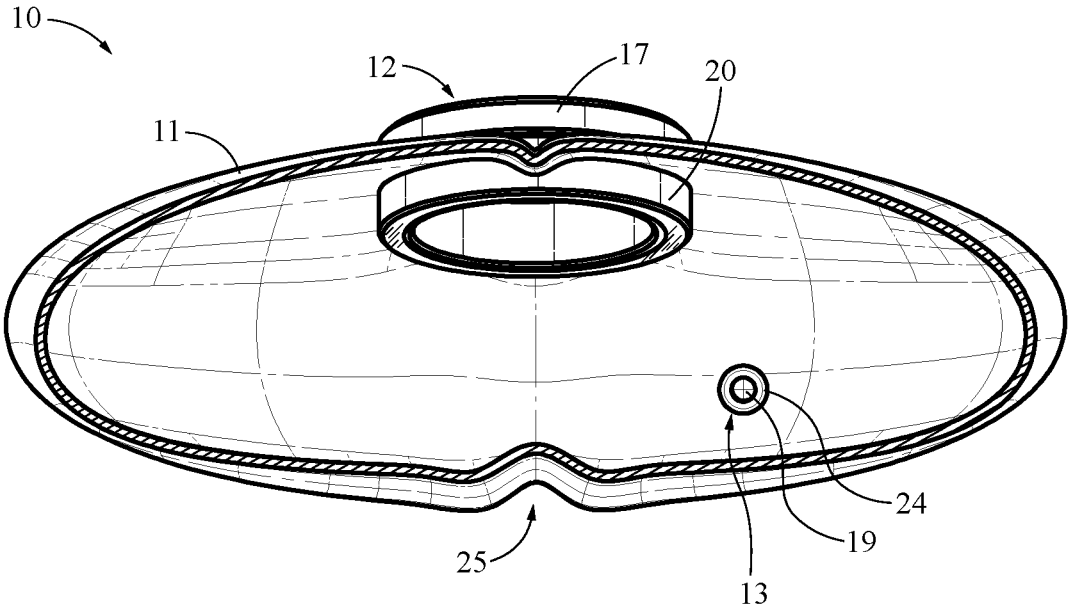
FIG. 17 illustrates a cutaway bottom view of one embodiment the hydration system of FIG. 13 taken along lines C-C.
Figure 18:
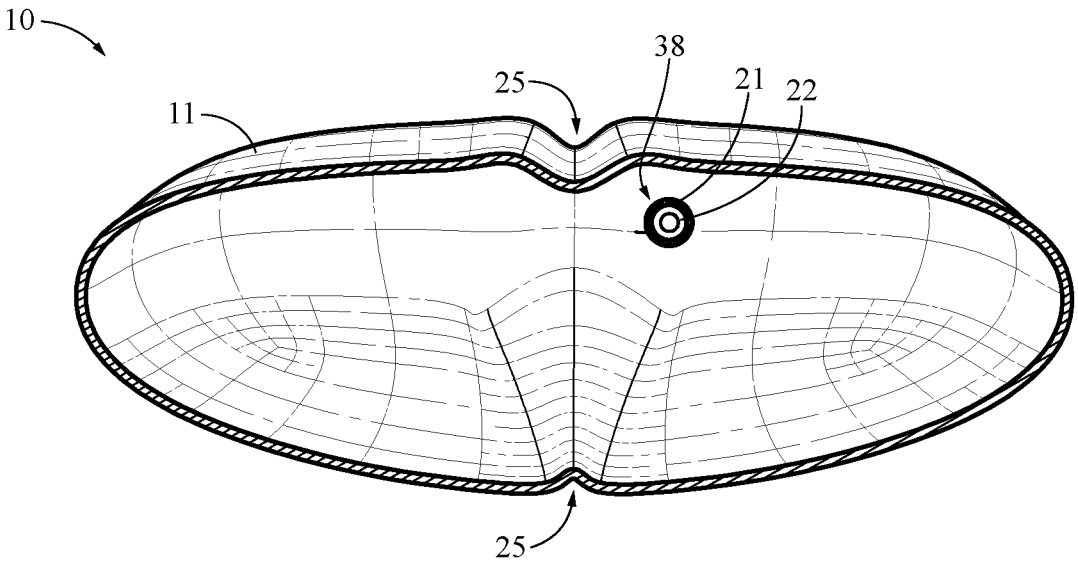
FIG. 18 illustrates a cutaway top view of one embodiment the hydration system of FIG. 13 taken along lines D-D.

Referring to FIGS. 10-11, a cutaway side view taken along lines A-A in FIG. 3 and a cutaway side view taken along lines B-B in FIG. 7, respectively are illustrated to show the cross-sectional shape of one embodiment of a hydration system 10. In this particular example, the reservoir 11 is slightly concave or arched to conform to a user's upper back, where the hydration system 10 is ideally mounted for use in recreational or outdoor activities. It can be seen that the shape is elongated vertically, and is relatively low profile in the horizontal dimension, allowing the reservoir 11 to properly fit within a specialized hydration backpack or inside a hydration bladder compartment in a hiking or tactical backpack.

Referring to FIGS. 12-19, several views of one embodiment of a rigid metal reservoir hydration system 10 are illustrated. In this particular embodiment, the reservoir 11 is more intricately curved and shaped as is demonstrated by added contour lines. One concern a user may have when using a rigid metal reservoir hydration system 10 may be the possibility that the reservoir 11 could be significantly dented or collapse in the event of the application of significant force. An example of this could be if a user leaned or fell back onto the reservoir 11. To strengthen the structure of the reservoir 11, a corrugation 25 may be added to the surface of the reservoir in order to add structural rigidity and strength to resist denting or collapsing of the reservoir 11 in the event that sudden significant force is applied to the reservoir 11. It is understood that more corrugations may be added to the surface of the reservoir 11 if needed or desired to increase the strength or aesthetics of the reservoir 11.

Figure 19:
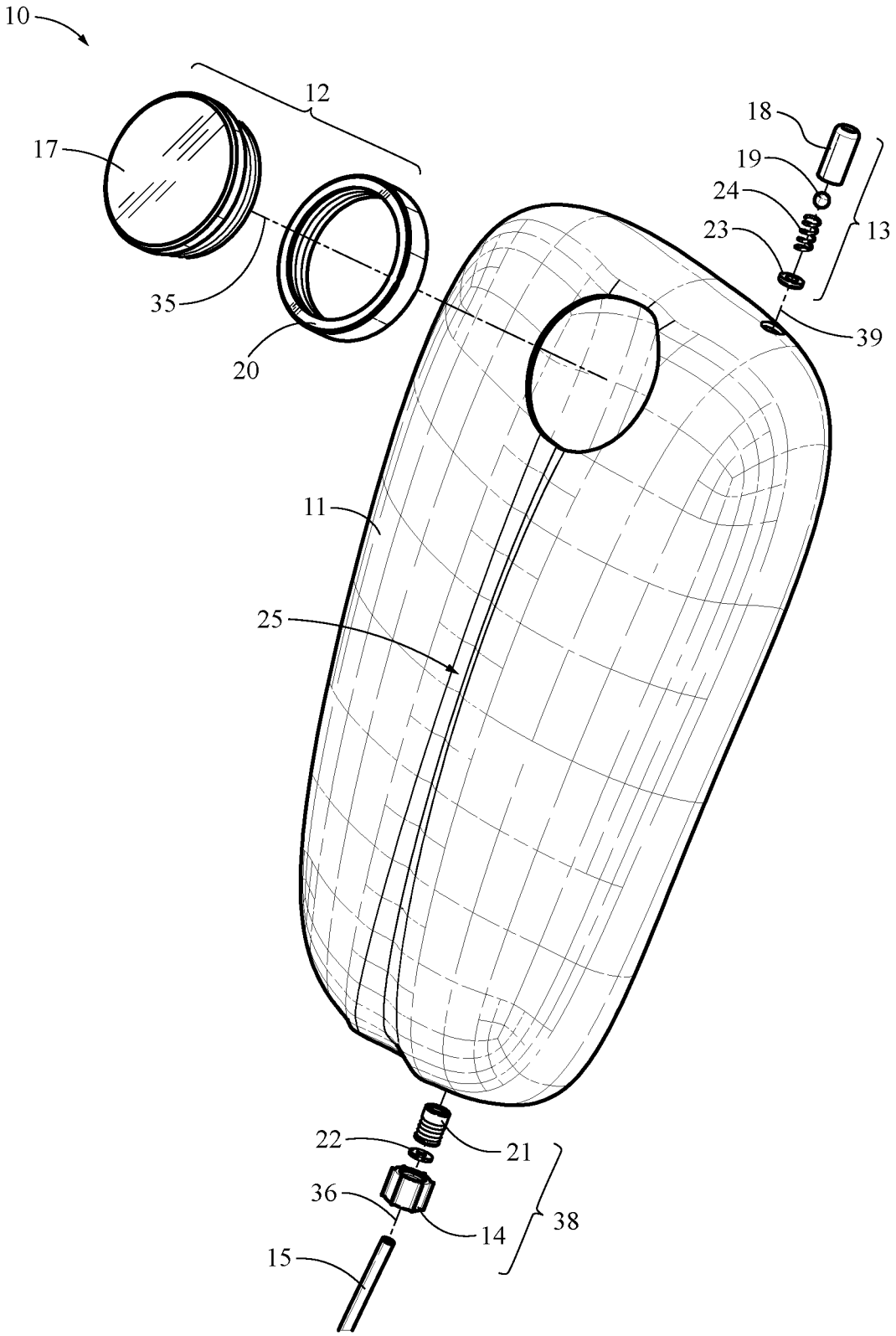
FIG. 19 illustrates an exploded view of one embodiment the hydration system of FIG. 12.
Figure 20:
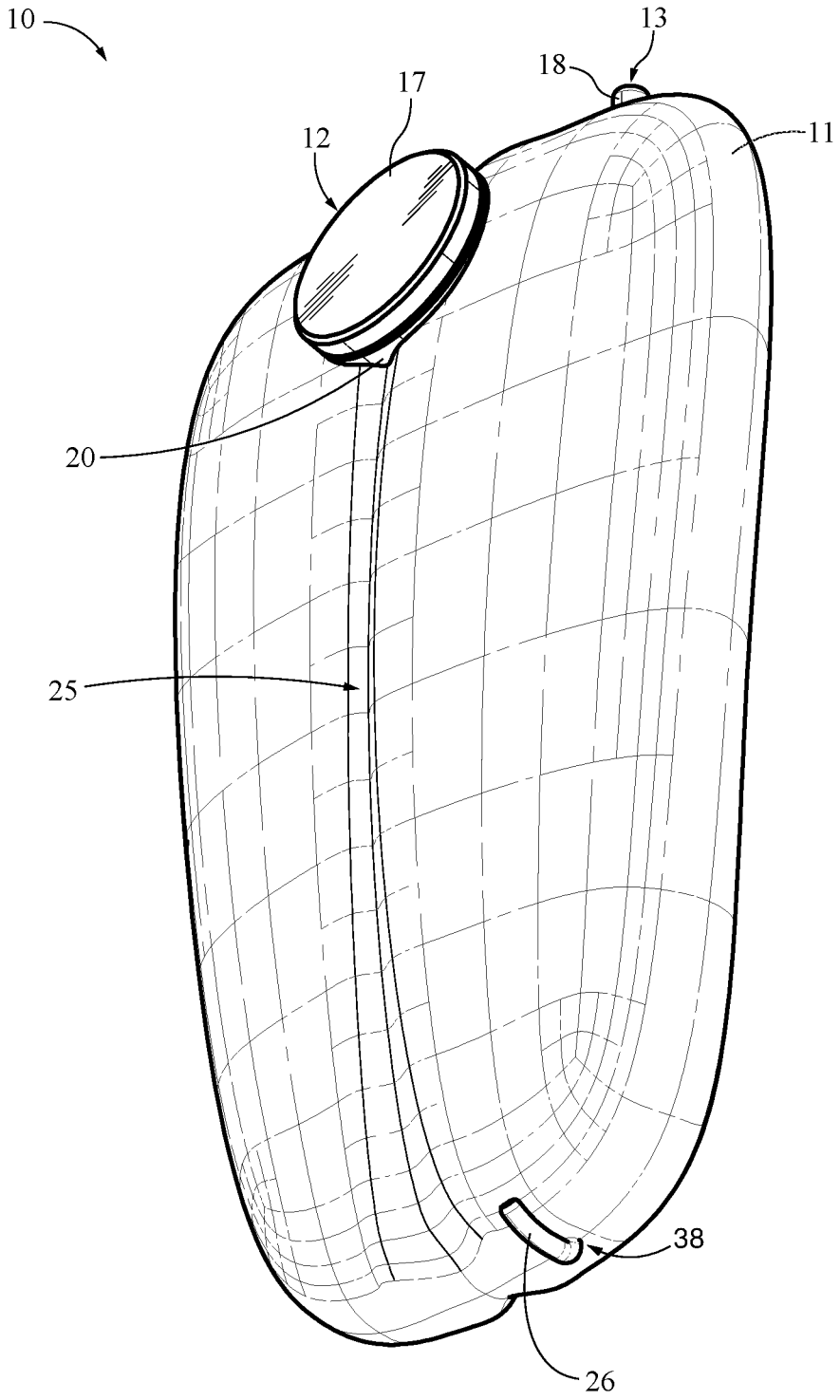
FIG. 20 illustrates an orthogonal view from the front of one embodiment the hydration system of FIG. 12.
Figure 21:
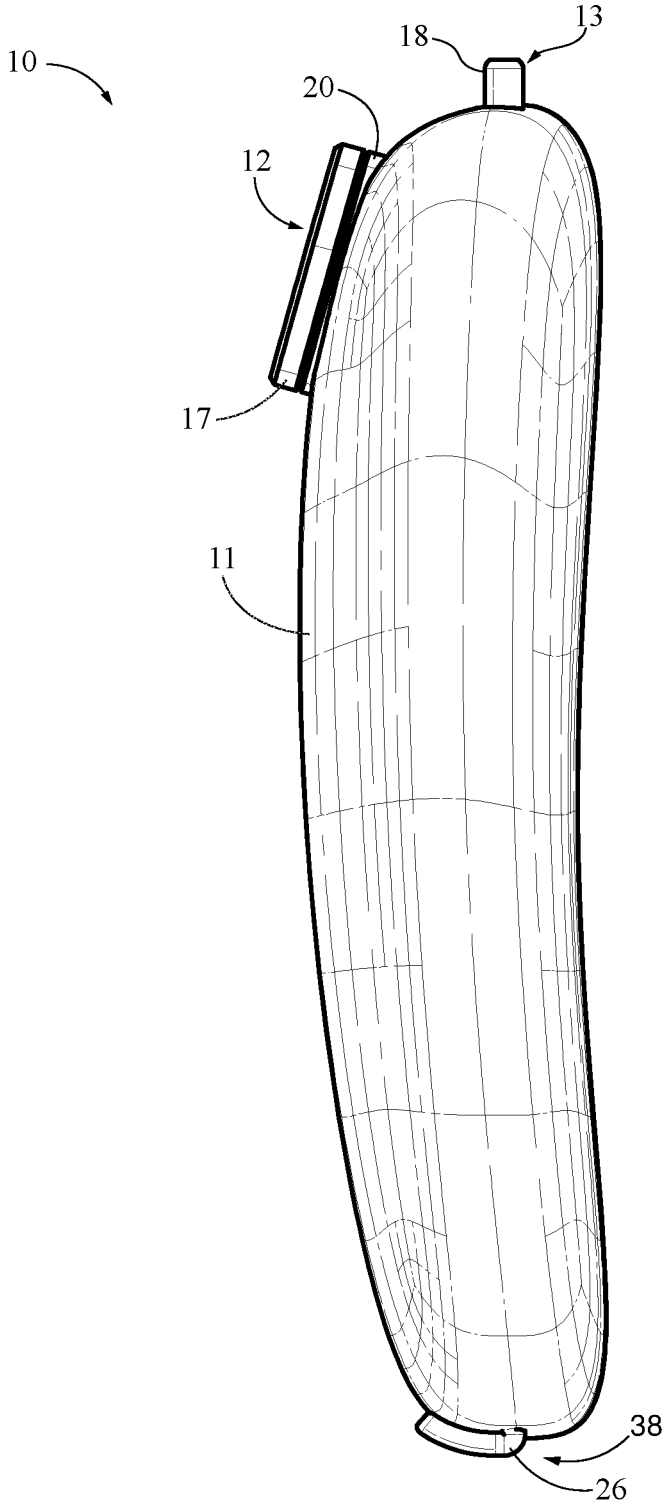
FIG. 21 illustrates a side view of one embodiment the hydration system of FIG. 12.
Figure 22:
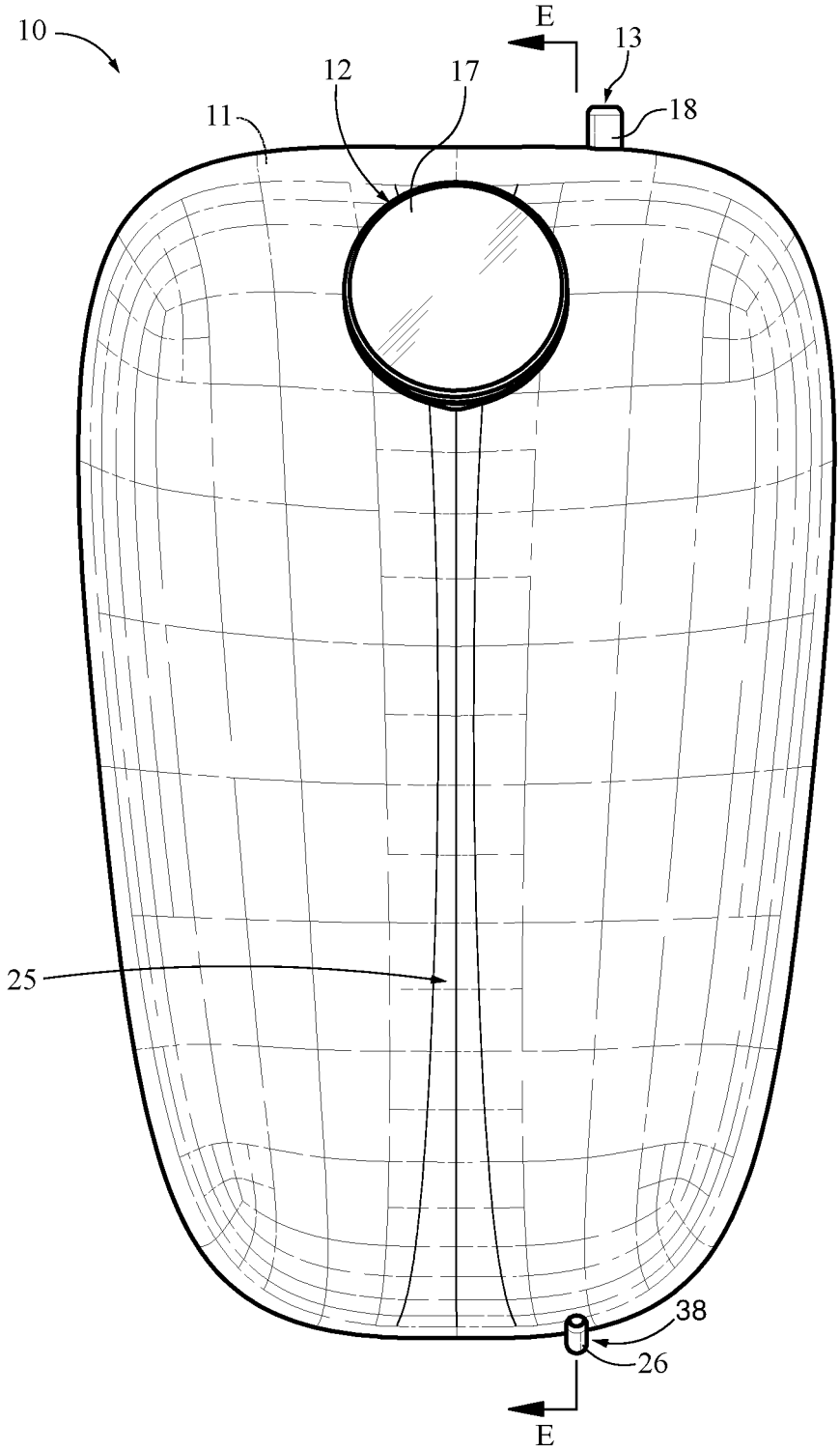
FIG. 22 illustrates a front view of one embodiment the hydration system of FIG. 12.
Figure 23:
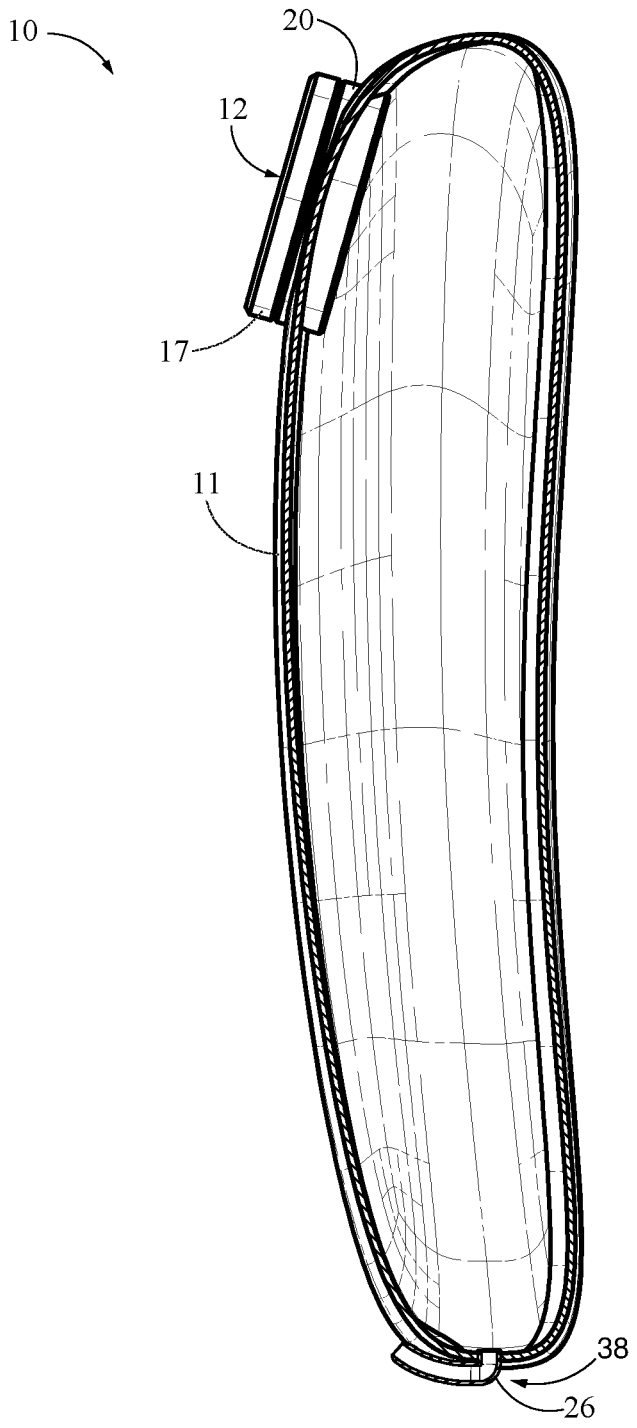
FIG. 23 illustrates a cutaway side view of one embodiment the hydration system of FIG. 22 taken along lines E-E.
Figure 24:
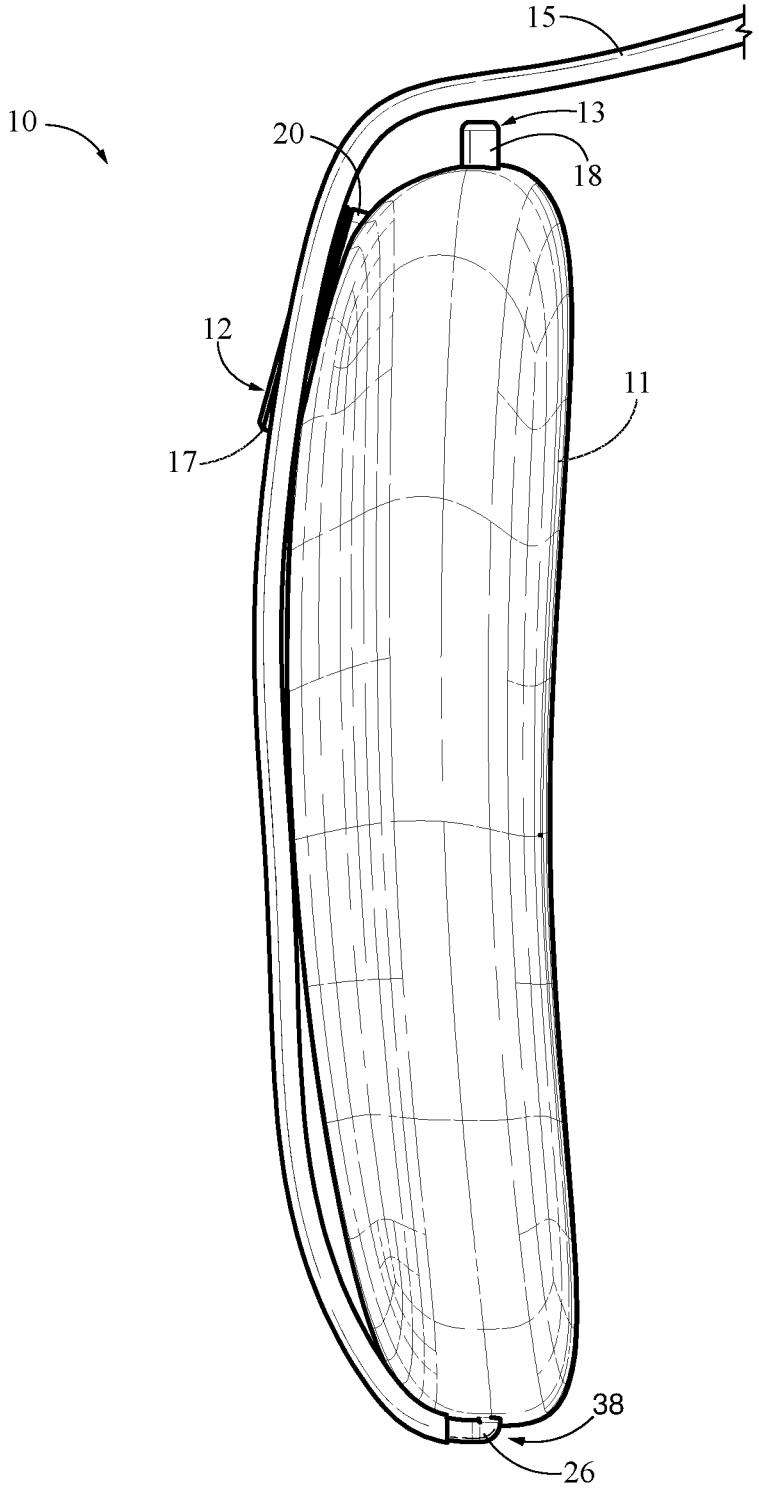
FIG. 24 illustrates a side view of one embodiment the hydration system of FIG. 12, with a drinking tube attached.

Referring to FIG. 19, an exploded view of one embodiment of a hydration system 10 is shown. In this particular embodiment, a better view of the components of the check valve assembly 13 can be seen. In this particular embodiment, a hole at the top of the reservoir 11 receives the check valve assembly 13, which comprises the upper check valve body 18, the lower check valve body 23, the check valve spring 24, and the check valve ball 19. The upper check valve body 18 is a hollow cylinder inside which are mounted the check valve spring 24 and the check valve ball 19. The check valve ball is pressed by the spring 24 against a seat integrally formed inside the upper check valve body 18 creating a water-tight seal. The lower check valve body 23 is affixed to the upper check valve body 18 in such a manner as to compress the spring 24, thus applying force to the ball 19 along the check valve axis 39.

The purpose of the check valve assembly 13 is to allow air to make up the volume of liquid leaving the reservoir 11 as the user of the system 11 drinks the liquid through the drinking tube 15 and bite valve 16. As water exits the reservoir 11 accordingly, the air pressure inside the reservoir becomes lower than the atmospheric pressure outside the reservoir 11, and air is allowed to enter the reservoir 11 through the check valve assembly 13 as the vacuum force created exceeds the force of the check valve spring 24, breaking a seal created between the check valve ball 19 and the upper check valve body 18.

It is understood that a person skilled in the art understands the typical operation and function of a standard check valve, and as such, not every detail of the operation of the check valve assembly 13 of the particular embodiment detailed above may have been described. Accordingly, it is also understood that various other check valve types may be used for the above purpose.

In this exploded illustration, a more detailed view of the Inlet 12 can be seen, which comprises a lid 17 and a lid receiver 20. A hole near the top of the reservoir 11 receives the cylindrical lid receiver 20, which is affixed to the reservoir 11. The Inlet 12 is centered about the lid axis 35. It is understood that the location of the Inlet may vary for different embodiments of the system 10.

Referring to FIGS. 20-24, several views of one embodiment of a rigid metal reservoir hydration system 10 are illustrated. In this particular embodiment, the bottom spout tube 21, bottom spout gasket 22, and screw cap 14, illustrated in FIG. 19 are replaced by an angled bottom spout 26. A hole in the bottom side of the reservoir 11 receives the angled bottom spout 26, which is affixed to the reservoir 11. The angled bottom spout 26 protrudes downward from the bottom side of the reservoir 11, and bends toward the front side of the reservoir 11 and curves upward, which aids in directing the drinking tube 15, shown in FIG. 24, back upward toward the top so that it may be routed to the user for drinking. The angled bottom spout 26 is sized so that the drinking tube 15 may snugly be fitted over the spout 26 to form a water-tight seal, allowing the flow of liquids from the reservoir 11 through the spout 26 and drinking tube 15 to the user's mouth for drinking.

Figure 25:
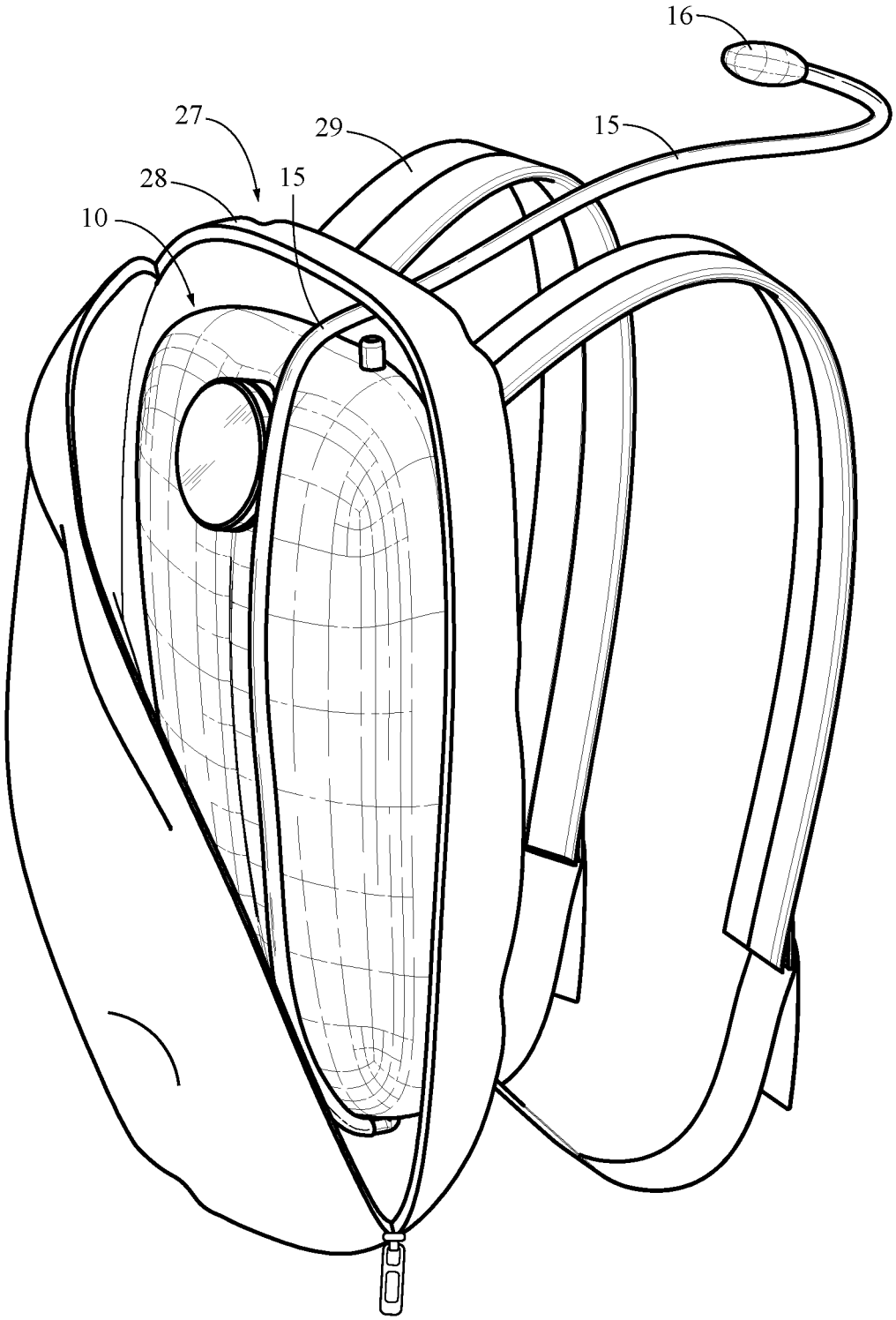
FIG. 25 illustrates an orthogonal view of one embodiment the hydration system of FIG. 12, mounted inside a backpack.

Referring to FIG. 25, one embodiment of a rigid metal reservoir hydration system 10 is illustrated, mounted within a backpack 27. The backpack 27 is partially unzipped in order to show the main parts of the hydration system 10 and how it may be oriented inside a backpack 27. The backpack shoulder straps 29 hold the backpack 27 onto a user of the hydration system 10. A backpack compartment 28 holds the hydration system 10 in place. The drinking tube 15 is routed upward through the backpack compartment 28 and out of the compartment 28 toward the user's mouth for drinking. Some hiking backpacks currently available are sized just large enough to hold a hydration system 10 and some other small items inside. Other backpacks are much larger and are designed with multiple compartments for holding various outdoor equipment and supplies. Many of these larger backpacks have a dedicated compartment for a hydration system 10. The rigid metal reservoir hydration system 10 is designed to fit into any standard backpack's hydration system compartment as well as in a specialized backpack 17 designed to be sold with the rigid metal reservoir hydration system 10 as a complete package. Some users may find it beneficial to purchase the rigid metal reservoir hydration system 10 alone without a backpack, and replace their existing flexible plastic bladder hydration system in their existing backpack with the rigid metal reservoir hydration system 10. Therefore, a rigid metal reservoir hydration system 10 may be sold with or without a backpack 17.

Figure 26:
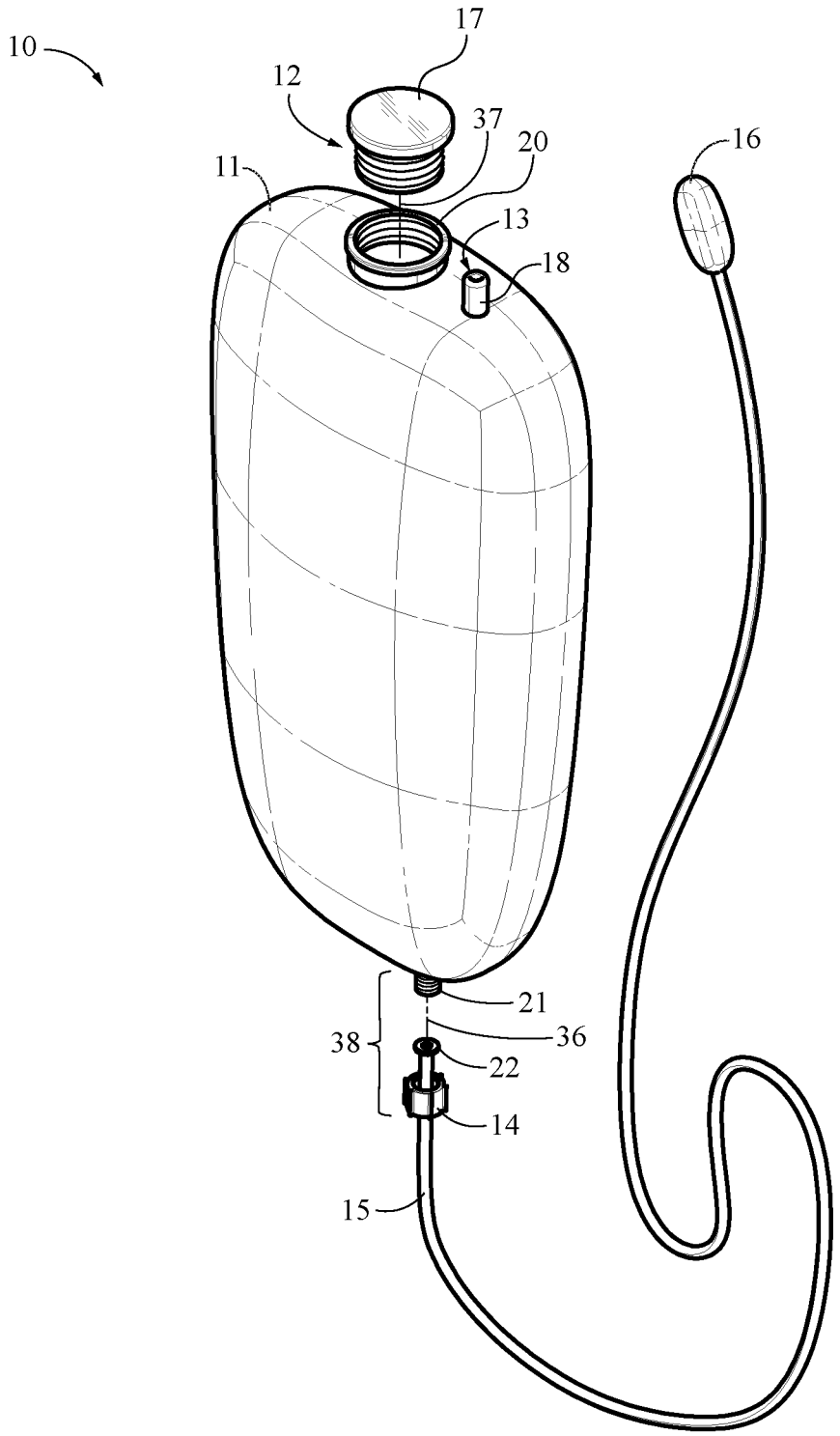
FIG. 26 illustrates an orthogonal view of one embodiment of a hydration system.

Referring to FIG. 26, one embodiment of a rigid metal reservoir hydration system 10 is illustrated. In this particular embodiment, the shape of the reservoir 11 is slightly less complex, and the Inlet 12 is located on top of the reservoir 11 and is slightly smaller than in other embodiments illustrated.

Figure 27:
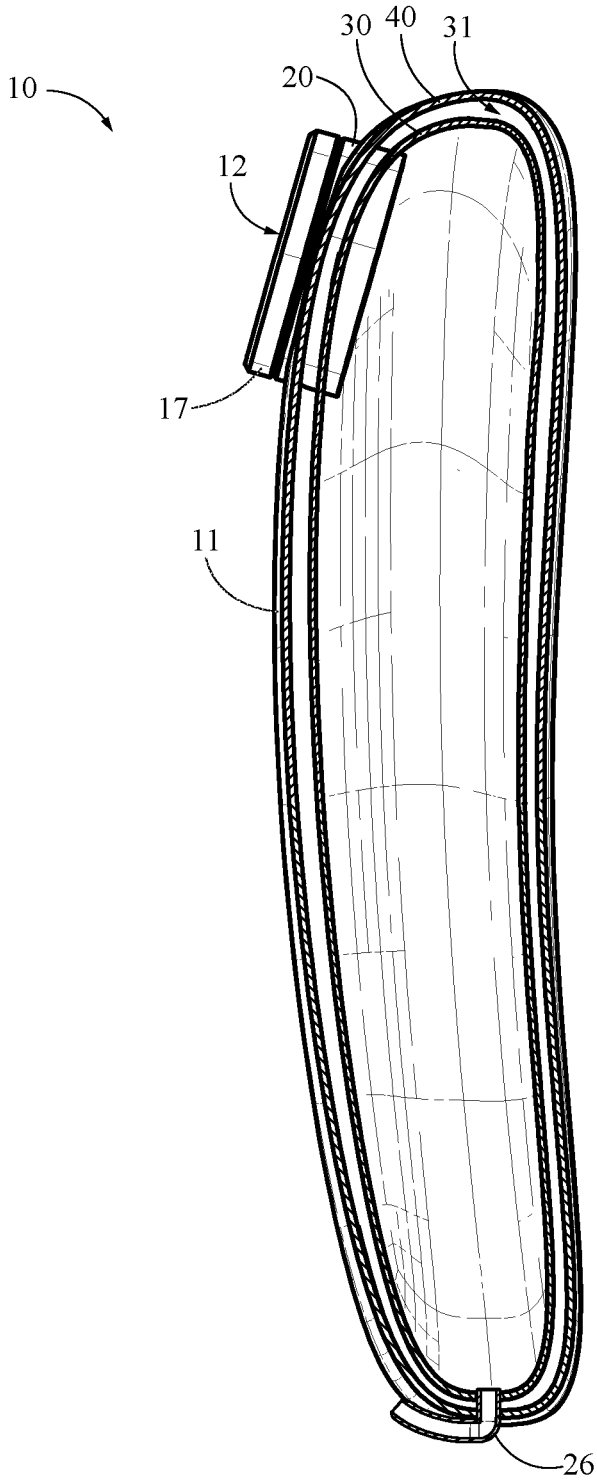
FIG. 27 illustrates a cutaway side view of one embodiment the hydration system of FIG. 22 taken along lines E-E.

Referring to FIG. 27, one embodiment of a rigid metal reservoir hydration system 10 is illustrated. In this particular embodiment, the reservoir 11 is double-walled and vacuum insulated, in order to keep liquids inside the reservoir cold or hot, as desired by the user. In order to achieve insulation, the reservoir 11 includes a second, inner wall 30, and there is a vacuum space 31 between the inner wall 30 and outer wall 40 of the reservoir 11.

Figure 28:
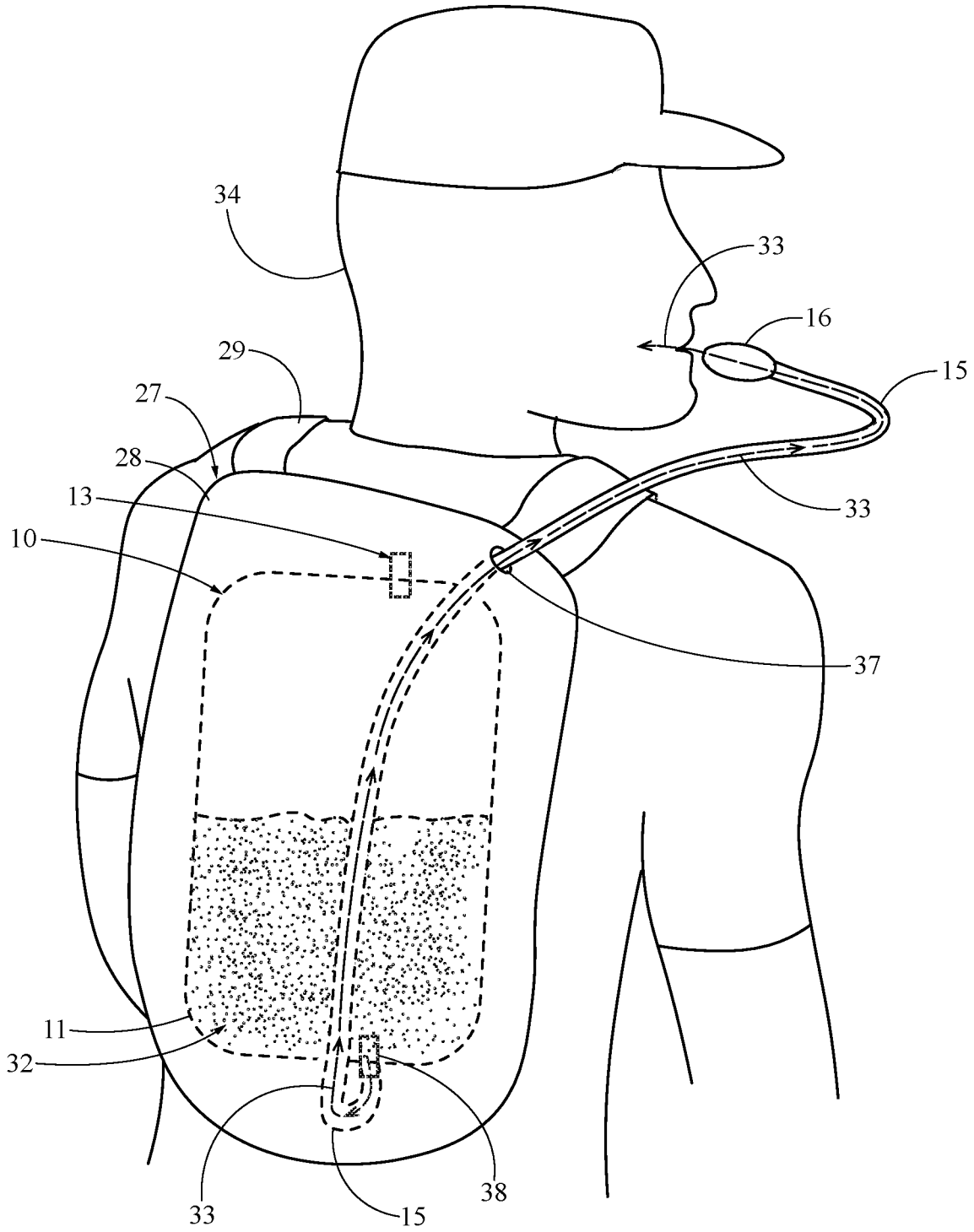
FIG. 28 illustrates a diagram of one embodiment the hydration system of FIGS. 1, 12, and 26, mounted in a backpack, which is mounted on a person, showing the use and function of the system.

Referring to FIG. 28, one embodiment of a rigid metal reservoir hydration system 10 is illustrated, showing how the system 10 works and how it is used. In this illustration a user 34 is shown wearing a backpack 27, which is strapped to the user 34 via backpack straps 29. The rigid metal reservoir hydration system 10 is mounted inside the backpack compartment 28. The hydration system temporarily stores a drinkable liquid 32, which is sucked through the drinking tube 15 by the user 34. The illustration depicts the flow 33 of the liquid 32 through the drinking tube 15 toward the user 34. The drinking tube 15 is routed upward from the bottom of the hydration system reservoir 11 inside the backpack compartment 28, and exits the backpack compartment 28 through an opening 37 in the backpack compartment 28. In order to cause the liquid 32 to flow into the user's 34 mouth, the user 34 must operate the bite valve 16 by biting down on the bite valve 16 and sucking the liquid 32 into the user's 34 mouth. The hydration system is primarily gravity fed, with the suction by a user's 34 mouth aiding in feeding a liquid 32 through the system. As liquid 32 exits the reservoir 11 through the outlet 38, a vacuum is created within the reservoir 11, which is relieved by air entering the reservoir 11 though the check valve assembly 13.

Figure 29:
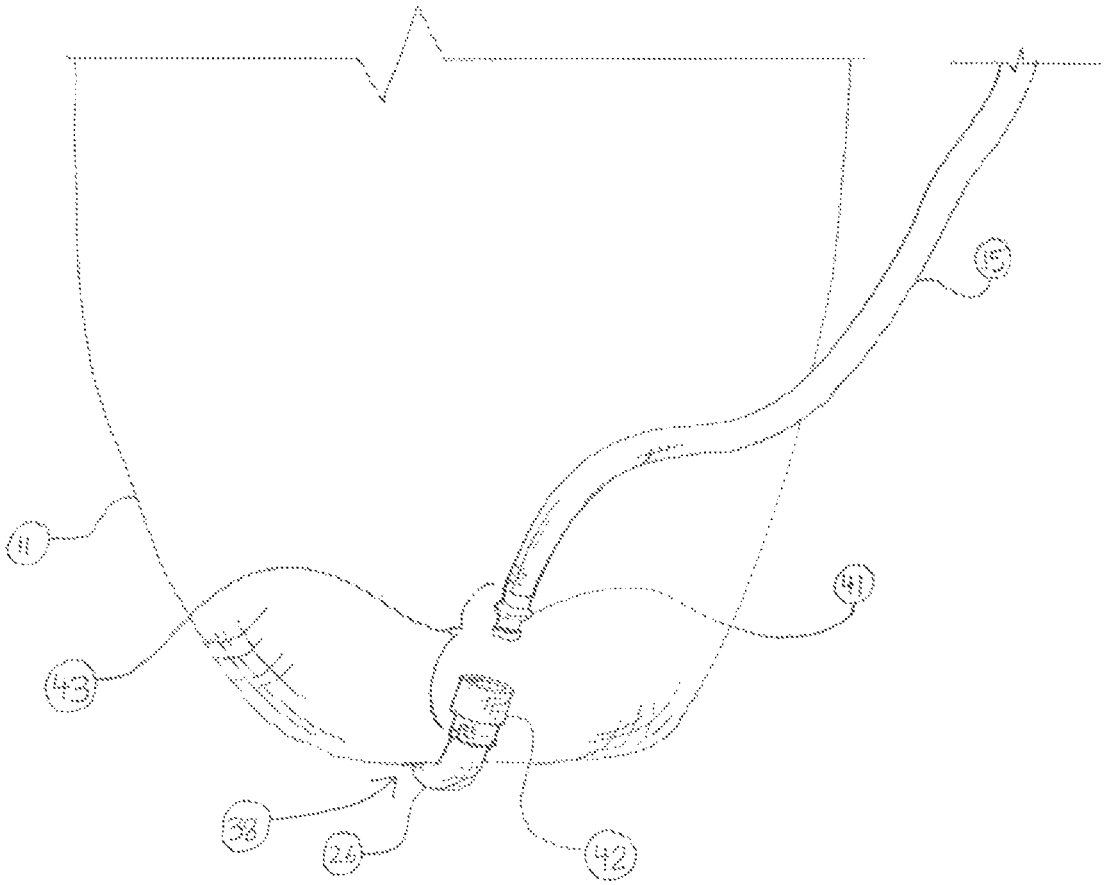
FIG. 29 illustrates a quick connect coupling assembly affixed to the outlet of one embodiment of a hydration system.
Figure 30:
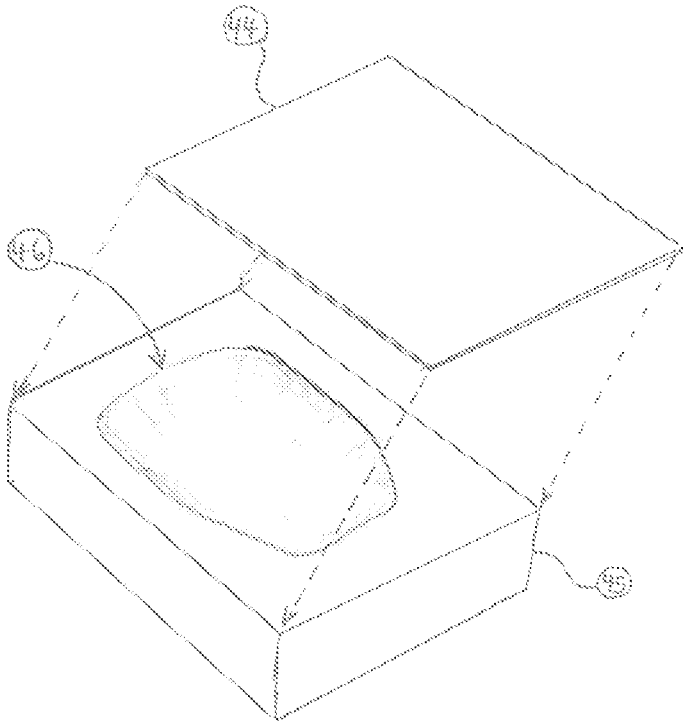
FIG. 30 illustrates steps of one process to make one embodiment of a hydration system.
Figure 30:
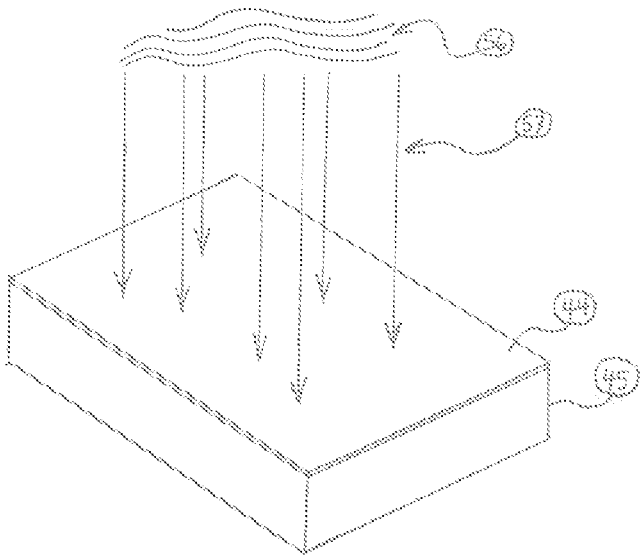
Figure 31:
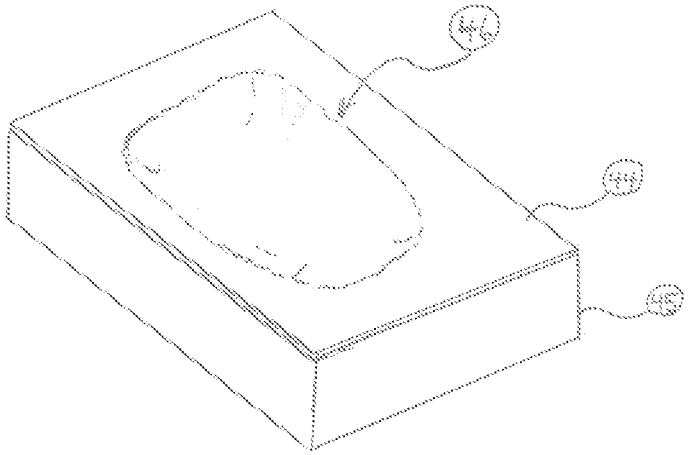
FIG. 31 illustrates steps of one process to make one embodiment of a hydration system.
Figure 31:
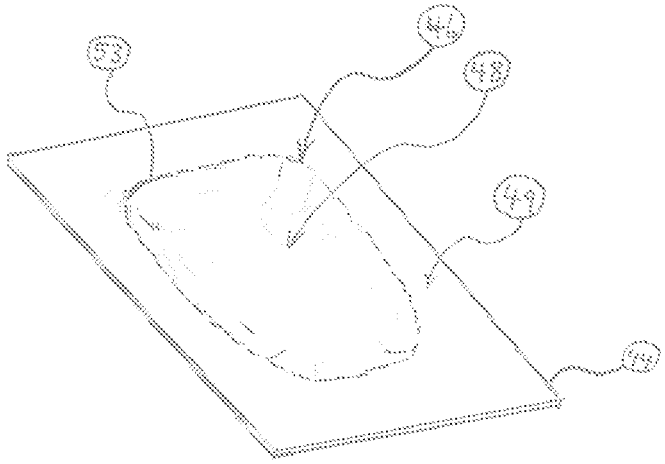
Figure 32:
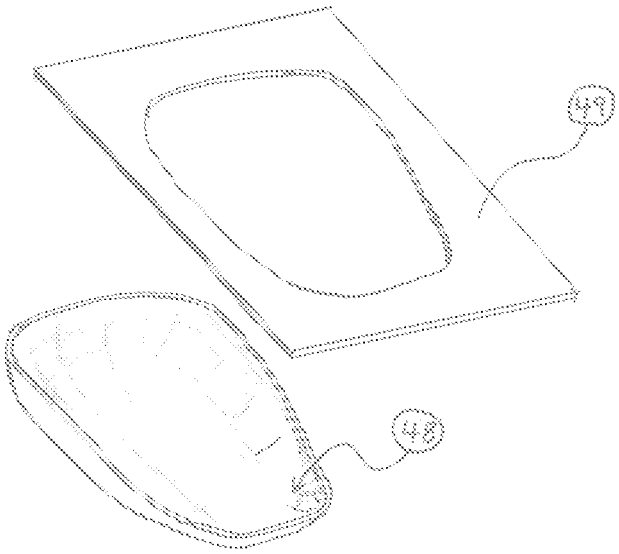
FIG. 32 illustrates steps of one process to make one embodiment of a hydration system.
Figure 32:
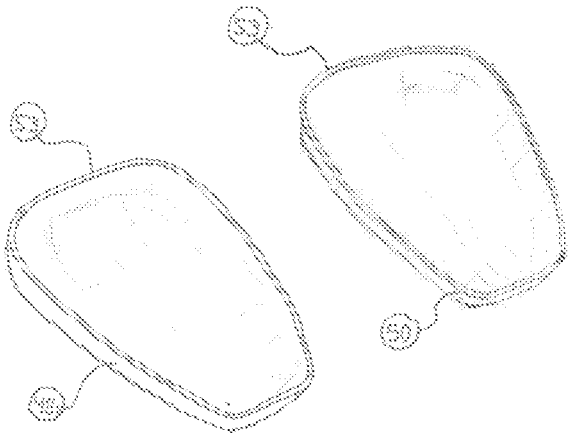
Figure 33:
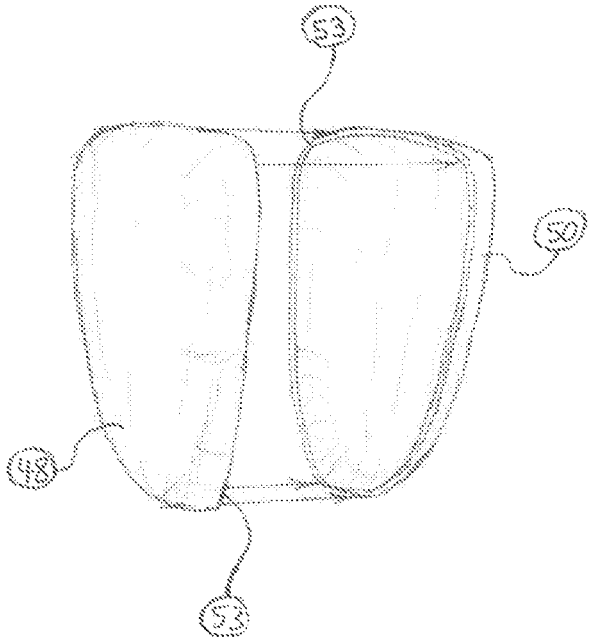
FIG. 33 illustrates steps of one process to make one embodiment of a hydration system.
Figure 33:
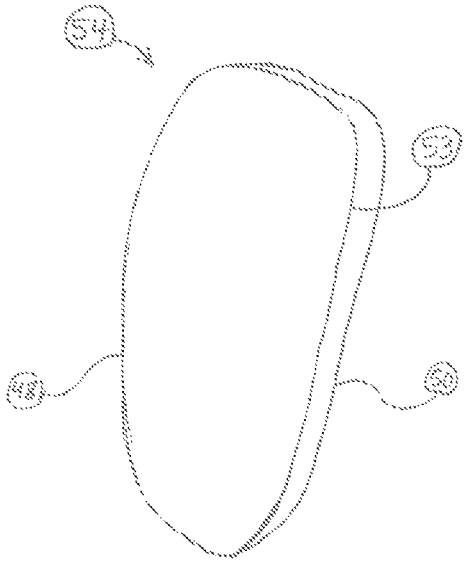
Figure 34:
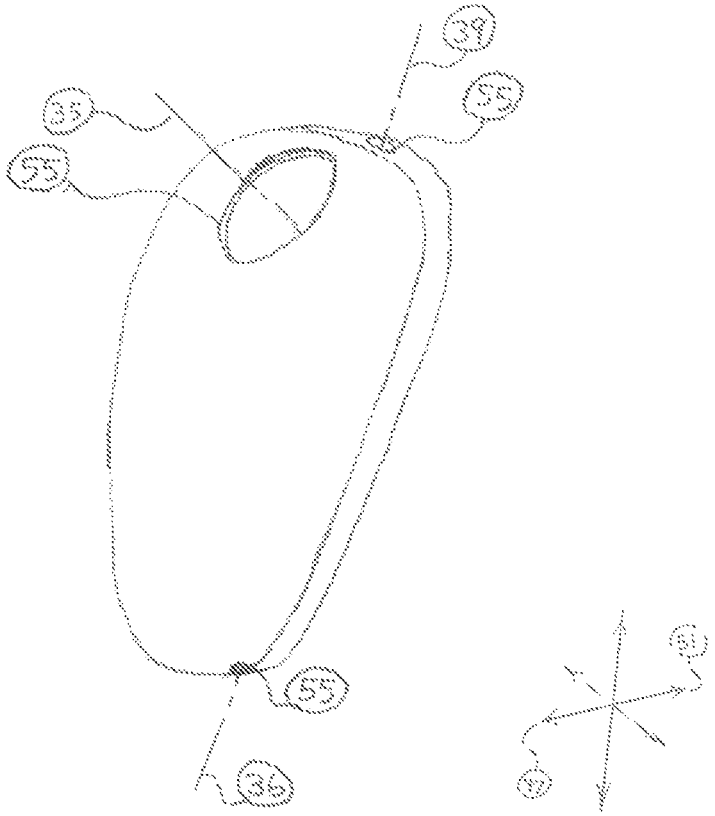
FIG. 34 illustrates steps of one process to make one embodiment of a hydration system.

Referring now to FIG. 29, a quick-connect fitting 41 is affixed to the drinking tube 15 at the end opposite the bite valve 16. The quick-connect fitting 41 may be easily coupled by the user to the quick-connect receiver 42, which is affixed to the end of the angled bottom spout 26. This quick-connect receiver 42 has a check valve within it that is closed when the quick-connect fitting 41 is decoupled from the quick-connect receiver 42. This allows the drinking tube 15 to be easily removed by the user while the reservoir 11 has water inside of it, without worry that the water will leak out through the outlet 38. This quick connect coupling 43 is very helpful to the user when the user needs to remove the reservoir 11 from the backpack (Refer to FIG. 28, No. 27) to refill or when the user needs to replace the drinking tube 15.

Referring now to FIGS. 30, 31, 32, 33, and 34, the process to make the current invention in the embodiment of a single-walled reservoir hydration system includes the following steps:

1. Sheet metal 44 is placed on top of a mold 45 with a cavity 46 in the shape of the front 47 half of the reservoir (Refer to FIGS. 1-29, No. 11).
2. Utilizing a hydraulic fluid 56, fluid pressure 57 is applied to the side of the sheet metal 44 opposite the mold 45.
3. The sheet metal is formed into the cavity 46, creating a front half-shell 48 of the reservoir (Refer to FIGS. 1-29, No. 11).
4. The front half-shell 48 is removed from the mold 45.
5. Excess material 49 is trimmed off of the newly formed part.
6. This process is repeated for the rear half-shell 50 of the reservoir (Refer to FIGS. 1-29, No. 11), substituting the mold 45 with a cavity 46 in the shape of the front 47 half of the reservoir (Refer to FIGS. 1-29, No. 11) with a mold 45 having a cavity 46 in the shape of the rear 51 half of the reservoir (Refer to FIGS. 1-29, No. 11), forming the rear half-shell 52.
7. The front half-shell 48 and the rear half-shell 52 are welded together along the joining plane 53.
8. A water-tight vessel 54 is formed which, when finished, will become the reservoir (Refer to FIGS. 1-29, No. 11).
9. Holes 55 are cut in the vessel 54 along the lid axis 35, the bottom spout axis 36, and the check valve axis 39.

Figure 35:
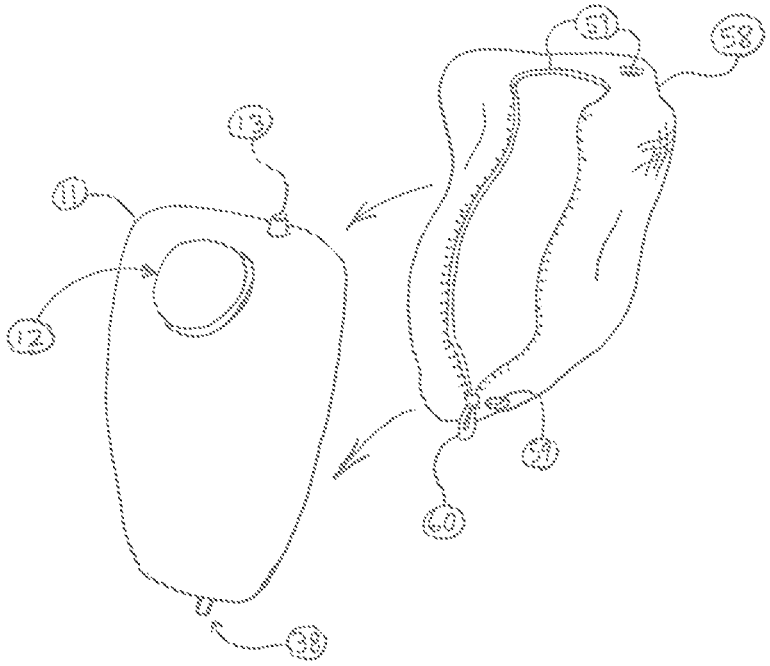
FIG. 35 illustrates steps of one process to make one embodiment of a hydration system.
Figure 35:
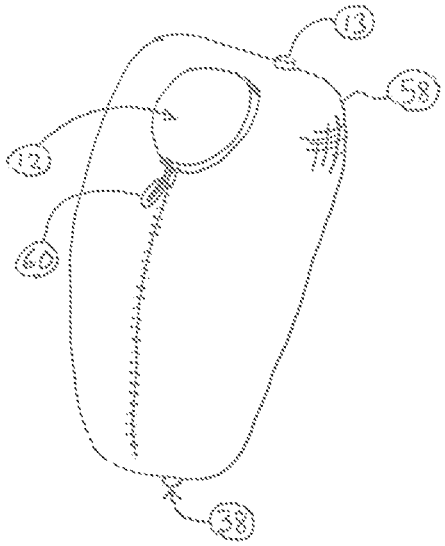

The following steps reference parts from FIGS. 1-29:

10. The lid receiver 20 is inserted into the hole centered about the lid axis 35, the bottom spout tube 21 or the angled bottom spout 26 is inserted into the hole centered about the bottom spout axis 36, and the check valve assembly 13 is inserted into the hole centered about the check valve axis 39, and each part is welded into place.
11. The lid 17 is screwed into the lid receiver 20, and the drinking tube 15 is connected to the outlet 38 by means of screwing the screw cap 14 onto the bottom spout tube 21, by sliding the drinking tube 15 over the angled bottom spout 26, or by coupling the quick-connect fitting 41 on the end of the drinking tube 15 to the quick-connect receiver 42 affixed to the bottom spout tube 21 or the angled bottom spout 26.
12. Referring now also to FIG. 35 (illustrations for Steps 12A and 12B), A neoprene jacket 58 is fit over the reservoir 11, with openings 59 for the inlet 17, outlet 38, and check valve assembly 13. This insulates the reservoir 11, which will keep the liquid inside the reservoir 11 cold for extended periods of time and will reduce condensation or sweating on the outer surface of the reservoir 11.

Figure 36:
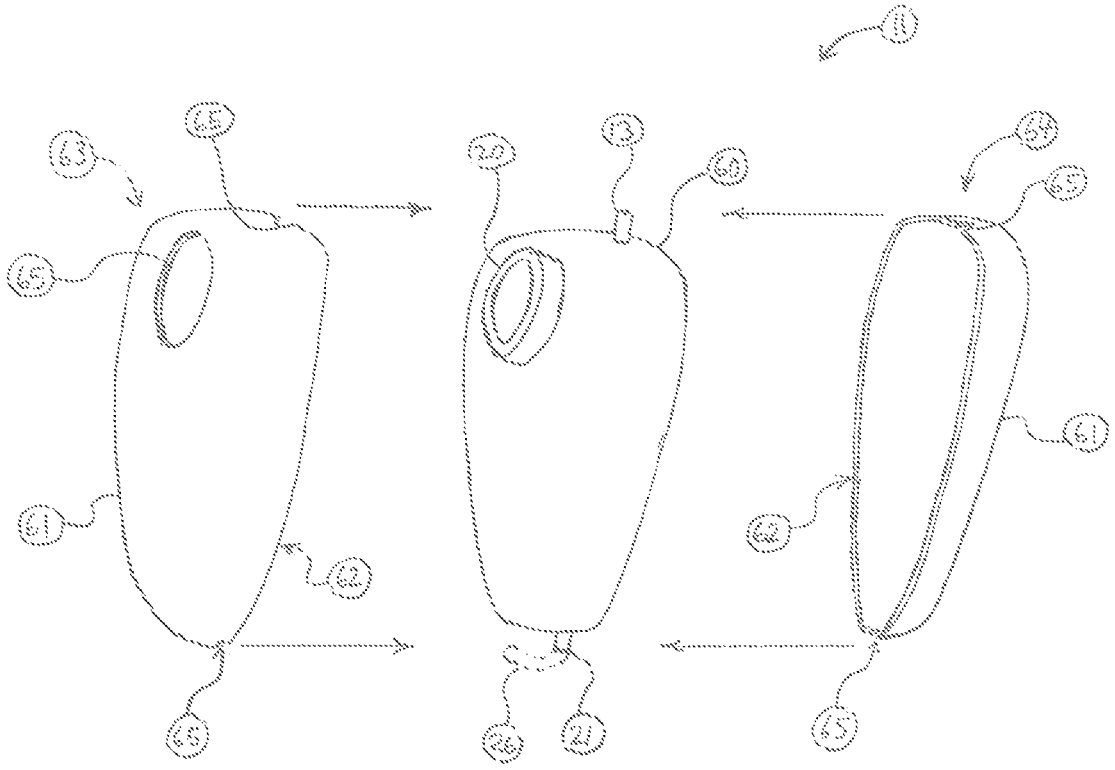
FIG. 36 illustrates steps of the process to make one embodiment of a hydration system.
Figure 37:
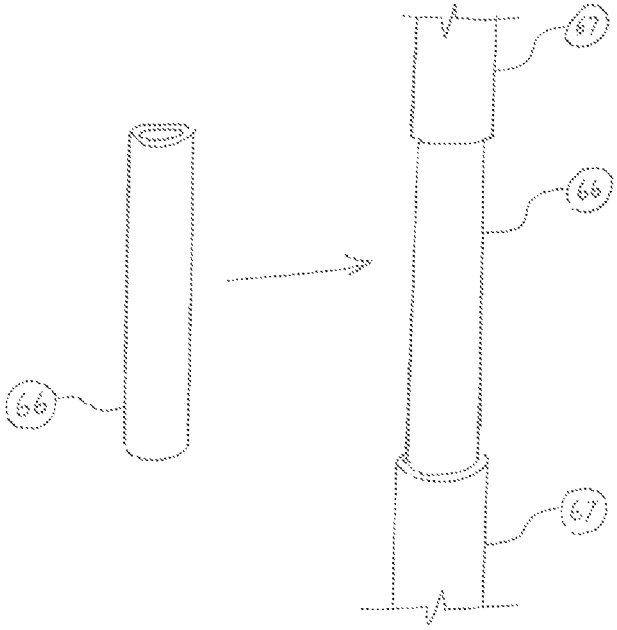
FIG. 37 illustrates steps of the process to make one embodiment of a hydration system.
Figure 37:
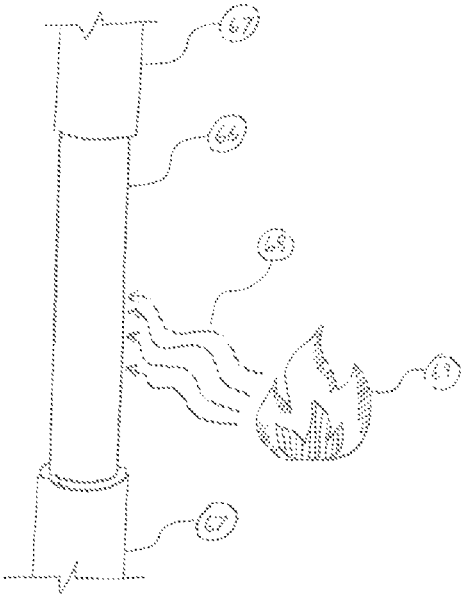
Figure 38:
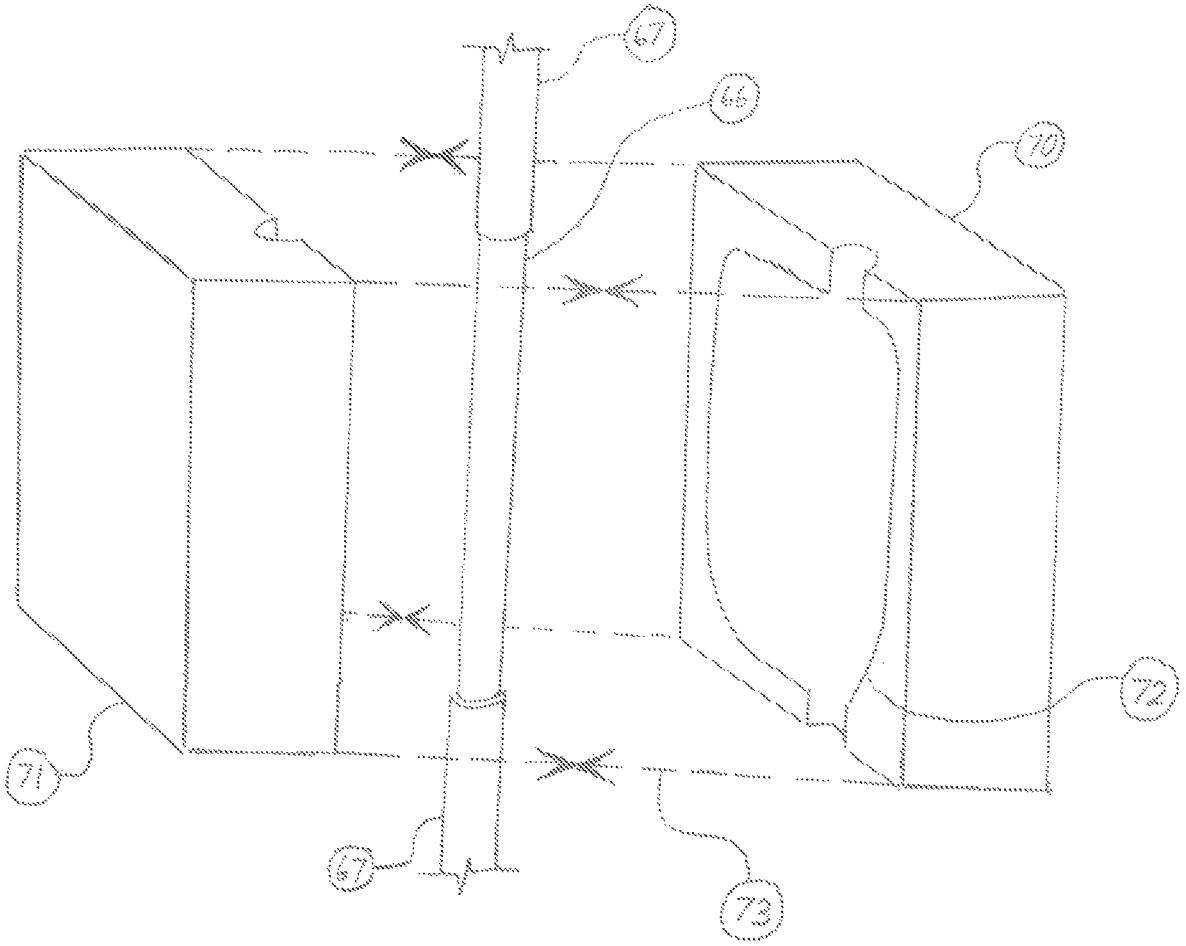
FIG. 38 illustrates steps of the process to make one embodiment of a hydration system.
Figure 39:
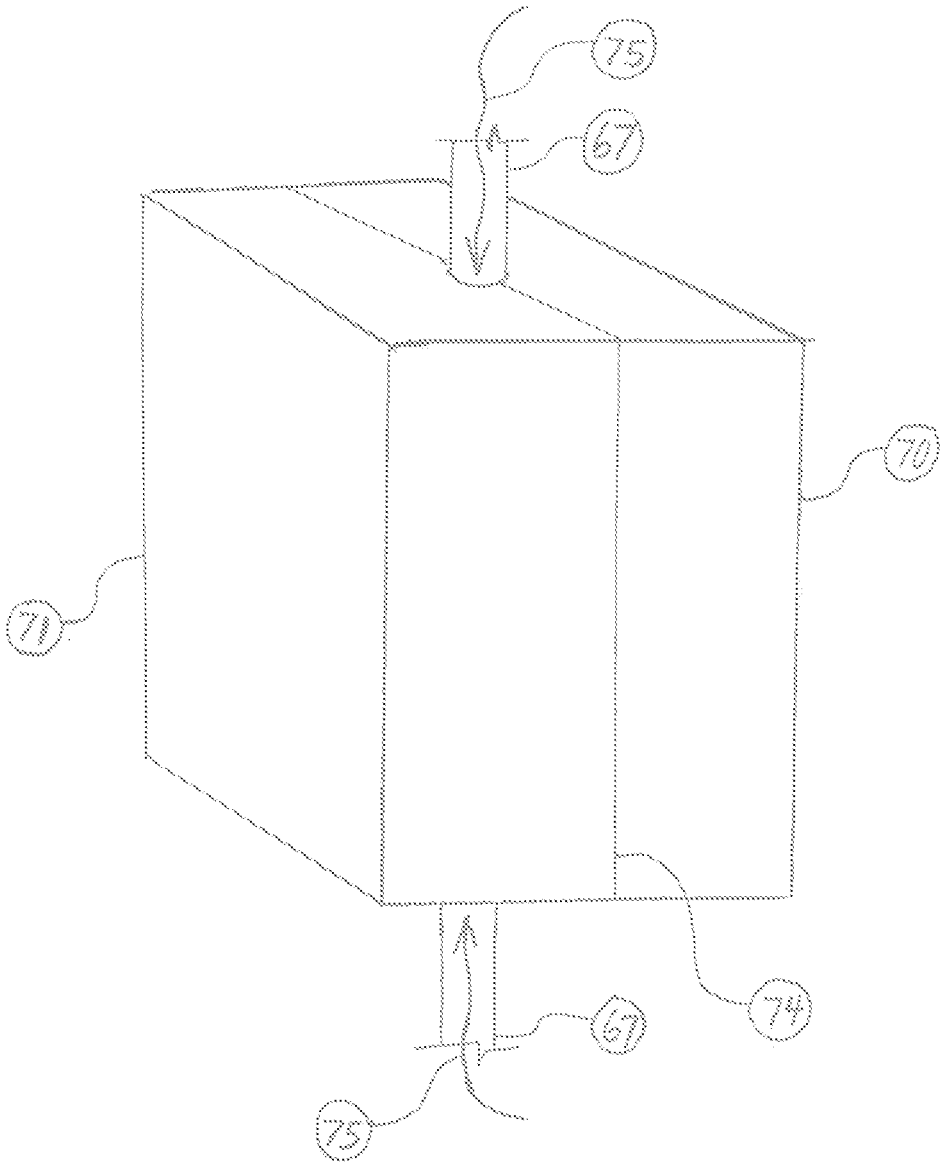
FIG. 39 illustrates steps of the process to make one embodiment of a hydration system.
Figure 40:
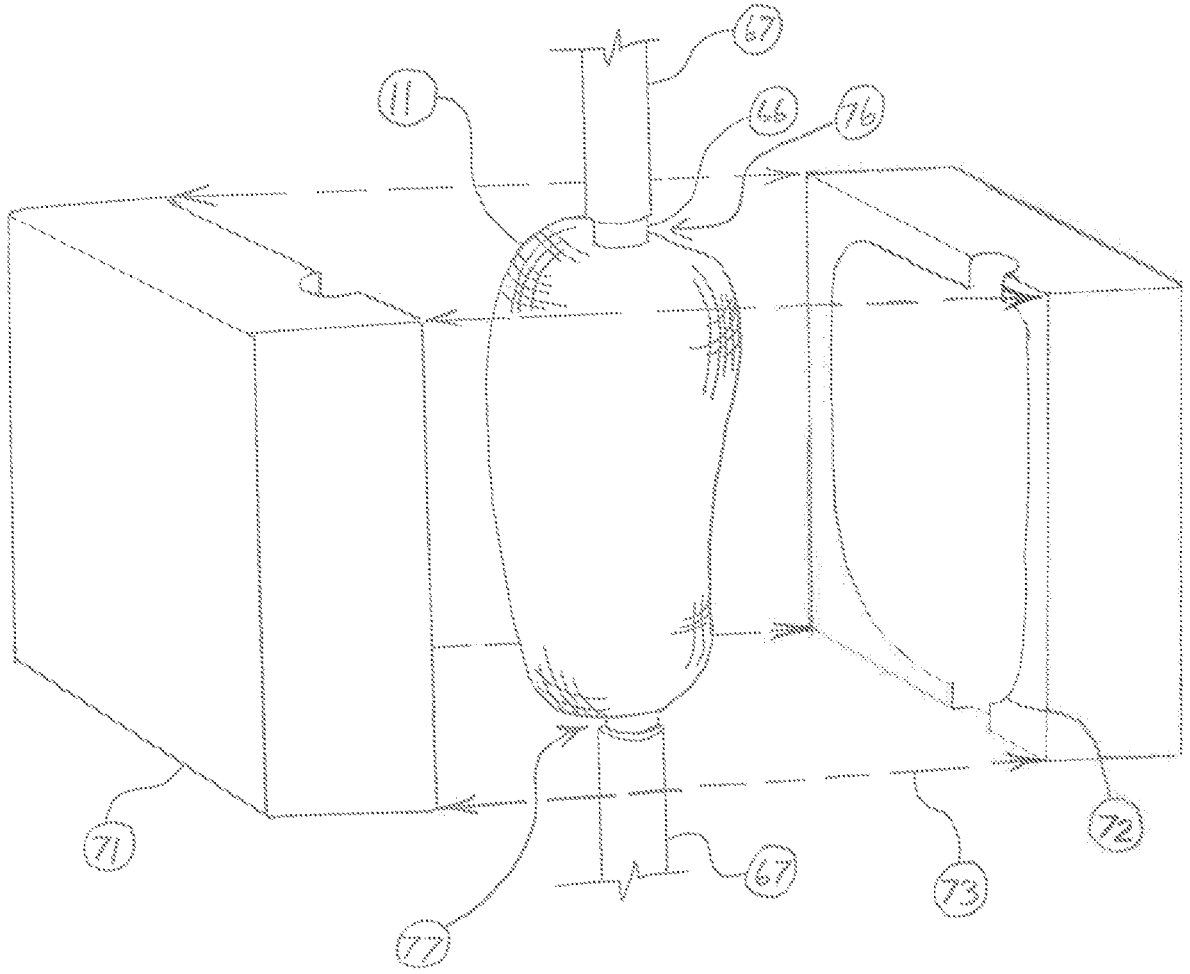
FIG. 40 illustrates steps of the process to make one embodiment of a hydration system.

The process to make the current invention in the embodiment of a double-walled reservoir hydration system includes all of the previous steps except for step number 12, and adds the following steps:

13. Referring now also to FIG. 36, for a double-walled embodiment of the present invention, continuing from step 10 above, the bottom spout tube 21 or angled bottom spout 26, the check valve assembly 13, and the lid receiver 20 are each slightly longer and protrude farther outward than the single-walled embodiment of the present invention to allow for the space between the inner reservoir wall 60 and outer reservoir wall 61. The outer reservoir wall 61 comprises a front half 63 and a rear half 64, which are formed in a similar manner as the front and rear halves of the inner reservoir wall 60 as described in steps 1-6 above. Openings 65 are made in the outer reservoir wall 61 to accommodate the protruding bottom spout tube 21 or angled bottom spout 26, the check valve assembly 13, and the lid receiver 20. The front half 63 and rear half 64 of the outer reservoir wall 61 are clasped together around the inner reservoir wall 60 and are welded together along the outer wall joining plane 62 to form an air-tight seal.

14. Through undisclosed methods a vacuum is created between the inner 60 and outer 61 reservoir walls, which serves as insulation to keep liquids inside the reservoir 11 cold or hot for extended periods of time and eliminates condensation or sweating on the outer surface of the reservoir 11.

Referring now to FIGS. 37, 38, 39, and 40, another process to make the present invention includes the following steps:

1. A metal tube 66 is used as stock for what will become the reservoir 11. The metal tube 66 is temporarily connected and sealed on either end to a gas delivery system 67.
2. Heat 68 is applied to the metal tube by means of a heat source 69. This will make the metal more pliable to the point that it may become closer to a plastic state. The metal tubular member may be heated by an electrical inductive heating method along the axial portions of said metal tubular member.
3. A rear half mold 70 and a front half mold 71, each having a cavity 72 in the shape of the reservoir 11, are brought together along the directional path 73 shown and are clamped together and around the metal tube 66 and gas delivery system 67, such that the metal tube 66 is suspended inside the cavity 72.
4. Now that the rear half mold 70 and front half mold 71 have been clamped together around the metal tube 66 and gas delivery system 67, a temporary seal is created along the joining plane 74, and hot fluid 75, which may be a gas or a liquid, is forced into the metal tube 66 through the gas delivery system 67. This causes pressure inside the metal tube 66 which stretches and deforms outward until it meets the cavity 72 walls and takes on the shape of the cavity 72. The hot fluid 75 may be fed into the metal pipe 66 through both ends or only one end.
5. The rear half mold 70 and front half mold 71 are separated and removed from their temporary clamped position around the metal tube 66 and gas delivery system 67, and are moved away from each other along the directional path 73 shown. The deformed metal pipe 66 is now exposed and has taken the shape of the cavity 72 and has become a semi-finished reservoir 11. The top 76 opening of the metal tube 66 may be used as an opening for the check valve assembly (Refer to FIGS. 1-4, 6-15, 17, 19-22, 24, and 26, No. 13) and may be cut at a desired distance from the newly formed part, and the bottom 77 opening of the metal tube 66 may be used as the outlet (Refer to FIGS. 1-3, 5-14, 16, 18-24, and 26-29, No. 38).
6. Steps 9-14 of the first process listed above to make the present invention as illustrated in FIGS. 30-36 may be followed to complete the current process of making the present invention.

Additional Modifications for Improvement to the System:

Weight may be a concern to users of the present invention, as many hikers, backpackers, and other users of hydrations systems often wish to minimize the weight of the loads they carry while performing outdoor and sporting activities. Therefore, efforts will be made to make the present invention as lightweight as possible. One such method may be to minimize the thickness of the metal walls of the reservoir 11. Since the thinning of the metal walls will typically reduce the resistance to deformation or crushing under stress or loads applied to the reservoir walls (e.g. dropping the reservoir on the ground, falling on top of the reservoir 11 while it is in a backpack, etc.), a sheath made of carbon fiber material or another light-weight composite may be wrapped around, conformed tightly to, and adhered to the metal reservoir walls in order to add strength to the metal walls of the reservoir 11. This in combination with various cross-sectional shapes of the reservoir 11 will help ensure a strong and lightweight hydration system reservoir 11.

It will be appreciated by those skilled in the art having the benefit of this disclosure that this rigid metal reservoir hydration system represents a new category in the outdoor products hydration space and solves many problems of current hydration systems for hikers, backpackers, cyclists, hunters, fishermen, and any other person needing hydration while enjoying an outdoor or sporting activity. As mentioned above, the present invention's contoured and low-profile shape made possible through new and novel metal forming, assembly, and production processes; check-valve; inlet and outlet; and structural features are novel aspects that make a metal reservoir hydration system viable and highly desirable, particularly given the rising concerns with possible side effects of plastic water containers as well as the typical pain points experienced with the use of plastic reservoirs. As described above, the present invention eliminates the taste of any plastic or chemical from the dispensed drinking water, eliminates the use of plastic polymeric compounds and plasticizers which may exhibit estrogenic activity (EA) leaching into the system's drinking water, reduces the amount of cleaning required, provides a mold and mildew resistant solution, provides a more puncture-resistant solution, provides significant improvements in thermal insulative quality to keep water and other drinks cold, eliminates condensate sweating, and provides an improvement in volumetric stability.

It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims Thus, it is intended that the following claims be interpreted to embrace all such further modifications, changes, rearrangements, substitutions, alternatives, design choices, and embodiments.

What is claimed is:

1. A back-mounted hydration system comprising
a rigid metal reservoir;
an inlet;
an outlet;

a check valve assembly which allows air to enter the reservoir as liquid exits;

a flexible drinking tube;

wherein the flexible drinking tube comprises flexible copper tubing having a first end and a second end, the first end being affixed to a fitting at the outlet at the bottom end of the reservoir, and the second end being affixed to a valve, which may be operated by a user's mouth via biting pressure, whereby the liquid may be delivered to the user's mouth for drinking on demand and at the will of the user;

and wherein the flexible drinking tube may be flexed and bent by the user into a position or orientation and stays in that position or orientation after the user relinquishes deliberate contact with and is finished adjusting the drinking tube; wherein the flexible copper tubing is surrounded by a sheath comprised of carbon fiber, which is glued, epoxied, or otherwise permanently adhered to the copper tubing, that will allow the copper tubing to bend, but will restrict the bending radius enough so that the copper tubing will not become creased or crimped.

2. The hydration system of claim 1, wherein the reservoir is double-walled, creating an insulating vacuum in the space between the two walls.

3. A back-mounted hydration system comprising a rigid metal reservoir;

an inlet;

an outlet;

a check valve assembly which allows air to enter the reservoir as liquid exits;

a flexible drinking tube;

wherein the reservoir is surrounded by a sheath comprised of carbon fiber, which is glued, epoxied, or otherwise permanently adhered to the reservoir wall, that will allow the outer walls of the reservoir to be made thinner to reduce the weight of the reservoir, while maintaining adequate strength for the intended use.

4. The hydration system of claim 3, wherein the reservoir is double-walled, creating an insulating vacuum in the space between the two walls.

* * * * *